US006658911B2

(12) United States Patent
McClung

(10) Patent No.: US 6,658,911 B2
(45) Date of Patent: Dec. 9, 2003

(54) METHOD AND APPARATUS FOR FORMING CONTAINER END SHELLS

(75) Inventor: James A. McClung, Canton, OH (US)

(73) Assignee: Sequa Can Machinery, Inc., Canton, OH (US)

( * ) Notice: Subject to any disclaimer, the term of this patent is extended or adjusted under 35 U.S.C. 154(b) by 2 days.

(21) Appl. No.: 10/171,266

(22) Filed: Jun. 12, 2002

(65) Prior Publication Data

US 2003/0056563 A1 Mar. 27, 2003

Related U.S. Application Data

(60) Provisional application No. 60/324,897, filed on Sep. 25, 2001.

(51) Int. Cl.[7] ..... B21D 28/00
(52) U.S. Cl. ..... 72/336; 72/348
(58) Field of Search ..... 72/329, 336, 348, 72/379.4; 413/56

(56) References Cited

U.S. PATENT DOCUMENTS

| | | | | |
|---|---|---|---|---|
| 3,844,145 A | * | 10/1974 | Bozek | 72/348 |
| 4,031,836 A | | 6/1977 | Grise et al. | |
| 4,116,361 A | | 9/1978 | Stargell | |
| 4,372,720 A | | 2/1983 | Herdzina et al. | |
| 4,516,420 A | | 5/1985 | Bulso, Jr. et al. | |
| 4,571,978 A | | 2/1986 | Taube et al. | |
| 4,574,608 A | | 3/1986 | Bulso, Jr. et al. | |
| 4,587,825 A | | 5/1986 | Bulso, Jr. et al. | |
| 4,713,958 A | | 12/1987 | Bulso, Jr. et al. | |
| 4,715,208 A | | 12/1987 | Bulso, Jr. et al. | |
| 4,716,755 A | | 1/1988 | Bulso, Jr. et al. | |
| 4,808,052 A | | 2/1989 | Bulso, Jr. et al. | |
| 4,977,772 A | | 12/1990 | Bulso, Jr. et al. | |
| 6,290,447 B1 | | 9/2001 | Siemonsen et al. | |

* cited by examiner

*Primary Examiner*—Lowell A. Larson
(74) *Attorney, Agent, or Firm*—Sand & Sebolt

(57) ABSTRACT

Method and apparatus for forming end shells for containers with a peripheral curl and an annular reinforcing rib in a single stroke cycle of a press which includes a punch core, a punch shell, and a pressure sleeve carried by an inner ram of the press. A cut edge is carried by an outer ram for forming a flat disc-shaped blank at a first level from a strip of sheet material. A die core is mounted on the base at a second level and is surrounded by concentric inner and outer die core rings. A cup-shaped blank is formed from the flat blank by movement of the punch core, pressure sleeve, and punch shell through a blank and draw die. The cup is clamped at the second level between the die core and punch core and formed into an end shell by movement of the punch core, pressure sleeve, and punch shell into clamping engagement with the die core, and inner and outer die core rings. Reverse movement of the outer die core ring and punch shell draws a peripheral edge of the end shell about a curl groove formed in the outer die core ring to form the peripheral curl. The end shell then is ejected form the press at the second level by pressurized air.

30 Claims, 22 Drawing Sheets

METHOD AND APPARATUS FOR FORMING CONTAINER END SHELLS

CROSS REFERENCE TO RELATED APPLICATION

This application claims priority from U.S. Provisional Patent Application Ser. No. 60/324,897 filed Sep. 25, 2001, the disclosure of which is incorporated herein by reference.

BACKGROUND OF THE INVENTION

1. Technical Field

The invention relates to a method and apparatus for forming end shells for metal containers, and particularly to forming the end shell with an annular reinforcing rib and a peripheral curl. Even more particularly, the invention relates to forming the reinforcing rib and peripheral curl on the end shell in a single press cycle in which the end shell is formed from a starting blank of sheet material.

2. Background Information

In the metal container art, containers usually consist of a body formed of lightweight metals such as an aluminum, and a separate end shell for closing the container, also formed of lightweight metal from strip material. It is desirable in forming the end shells to form a peripheral curl to enable the end shells to be stacked and transported between work stations without the end shells nesting too tightly together and sticking, hampering their movement through various production stages until they are ultimately seamed onto the finished container. This peripheral curl may also facilitates the seaming of the end shell on the open top of the container.

Various types of tooling has been developed for forming this peripheral curl, most of which requires a separate machine and tooling station separate from that of the press in which the end shell is formed. One common tooling uses curling rolls such as shown in U.S. Pat. No. 4,116,361. However, these prior art curl forming machines involve transporting the end shells from the forming press to a second station for the curling operation which requires additional equipment for handling the end shells.

Other types of tooling have attempted to form the peripheral curl on the end shell in the same press or tooling station in which the end shell is formed to avoid this transfer problem and expense. Examples of such single station tooling for forming the end shell and peripheral curl are shown in U.S. Pat. Nos. 4,031,836, 4,372,720, 4,574,608, and 6,290,447. In this type of tooling, the initial disc blank and final end shell having the peripheral curl thereon is formed and ejected from the press at the same level in the press. It has been found that production speed can be increased by performing several of the forming operations, such as blanking of the initial disc blank and forming a preliminary cup-shaped blank at a first level, and then final forming the end shell at a second level, at which level the shell is then ejected from the press. Examples of such multi-level end shell production type presses are shown in U.S. Pat. Nos. 4,903,521 and 4,977,772. However, none of these multilevel presses form a peripheral curl on the end shell.

It is also desirable to form an annular reinforcing rib in the end shell to provide strength and rigidity thereto. Various types of tooling have been developed for forming an annular reinforcing rib in the end shell between the central panel and peripheral edge. However, certain types of tooling use a die having a male portion which engages and forces the metal into an opposed complementary female die providing a positive engagement between the tooling and metal. This die contact can cause thinning and wrinkling of the metal due to the pressure exerted by the dies against the metal trapped therebetween. Examples of such tooling are shown in U.S. Pat. Nos. 4,516,420, 4,587,825, 4,713,958, 4,715,208, 4,716,755, 4,808,052, and 4,977,772. Another type of tooling pushing the metal into an enlarged cavity without a male or positive female die component, such as shown in U.S. Pat. Nos. 4,109,599 and 4,571,978. Since the cavity is enlarged, it does not form a true radius for the reinforcing rib, which can reduce to strength of the resulting rib.

Thus, the need exists for an apparatus and method for forming container end shells with an annular reinforcing rib and a peripheral curl in a single press cycle wherein the blanking and partial forming of the end shell is carried out at a first level and the formation of the final end shell, reinforcing rib and peripheral curling is carried out prior to ejection of the end shell from the press at the second level in order to increase the speed of production.

BRIEF SUMMARY OF THE INVENTION

The present invention provides an apparatus and method for forming an end shell for use on a container body which is formed in a single press cycle at a single work station wherein a portion of the end shell is produced at a first level and the final forming of the end shell, including forming an annular reinforcing rib and peripheral curl, is formed at a second level in the press, from which level the finished end shell is ejected.

Another aspect of the present invention provides for the forming of the end shell without complicated and expensive modifications for retrofitting existing presses and which eliminates the need for expensive and complicated transfer mechanisms for transferring the end shell to an adjacent curling station.

A further aspect of the invention preferably provides an apparatus and method for forming a plurality of the end shells in a single cycle of the press wherein the reinforcing rib and peripheral curl are formed on the end shell during the upward movement of an inner ram, and in which a curl forming outer die ring also functions as the lift ring for moving the completed end shell back to the second level for subsequent ejection from the press.

Still another feature of the invention is to form the annular reinforcing rib in the end panel of the shell just prior to forming the end curl during upward movement of an outer die core ring and aligned outer punch shell.

Another feature of the invention is forming the peripheral curl by increasing the overall outer diameter of the end shell in contrast to the heretofore methods and apparatus which reduce the diameter of the end shell to form the peripheral curl.

A further feature of the invention is to provide an apparatus and method for forming an end shell having an annular reinforcing rib and a peripheral curl which avoids any thinning of the metal and which prevents wrinkling of the metal by maintaining a portion of the frustro-conical chuckwall portion of the end shell in a secure clamped position between an inner pressure member and an inner die core ring during formation of the reinforcing rib and peripheral curl.

The present invention forms the peripheral curl by pivotally moving an outer portion of an elongated chuckwall of an end shell blank during reverse movement of an outer die core ring and outer punch sleeve by providing a slip-fit clamping engagement of the outer periphery of the chuckwall therebetween.

The present invention also forms an annular reinforcing rib in the end shell by pushing metal from the chuckwall into an annular groove or female die component formed in the punch core during reverse movement of an outer die core ring and outer punch sleeve wherein the groove matching the desired radius of the reinforcing rib and functions as the female die component, but without a male die component engaging the metal.

The foregoing advantages, construction, and operation of the present invention will become more readily apparent from the following description and accompanying drawings.

BRIEF DESCRIPTION OF THE DRAWINGS

Preferred embodiments of the invention, illustrative of the best modes in which applicant contemplates applying the principles of the invention, are set forth in the following description and are shown in the drawings and are particularly and distinctly pointed out and set forth in the appended claims.

FIG. 8AA is an enlarged view similar to FIG. 8A showing a modified punch shell configuration;

FIG. 9AA is a view similar to FIG. 9A utilizing the modified punch shell;

FIG. 10AA is a view similar to FIG. 10A utilizing the modified punch shell;

DETAILED DESCRIPTION OF THE INVENTION

Figure 1:
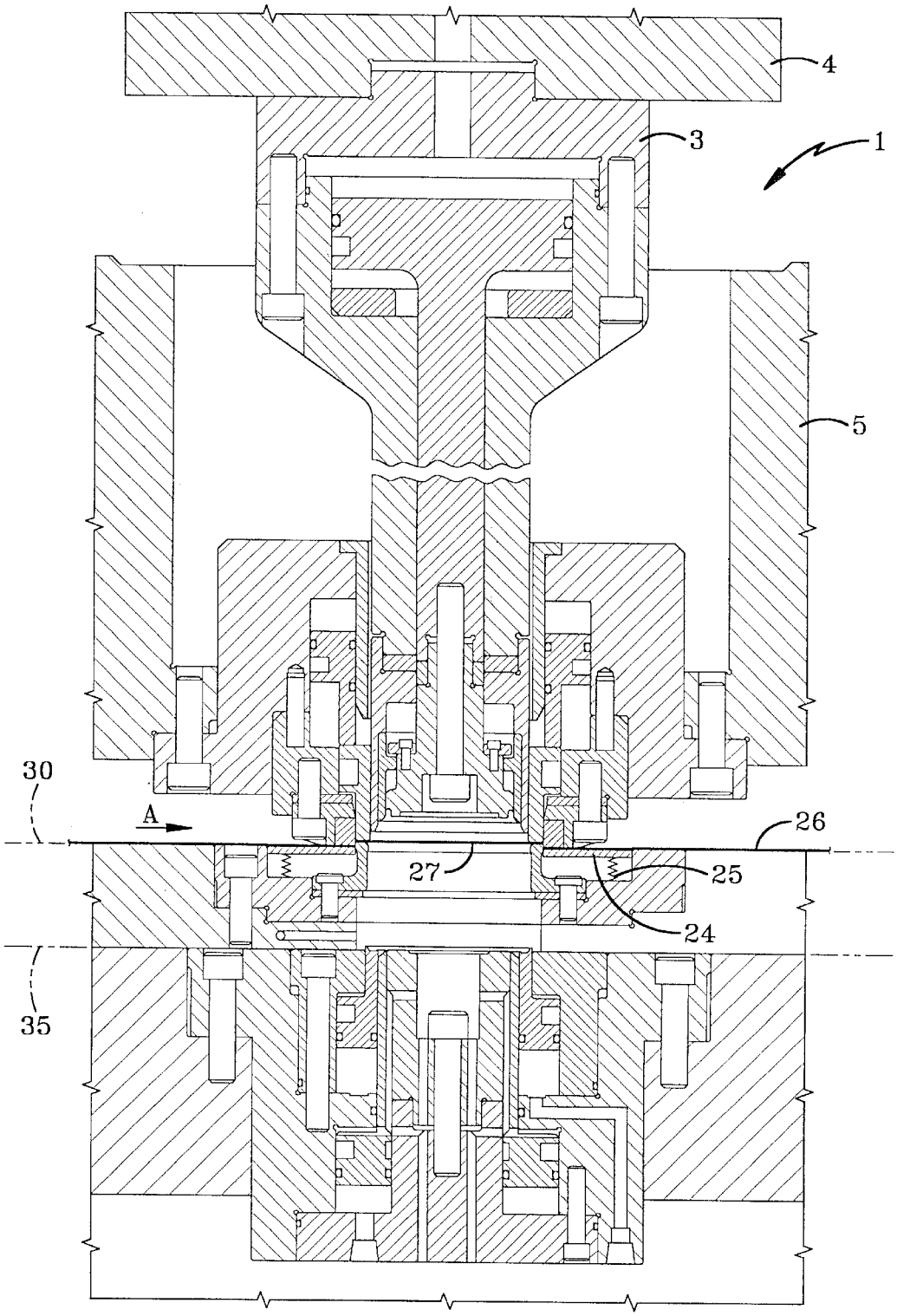
FIG. 1 is a partially schematic sectional view of the apparatus of the present invention mounted in a press and showing the blanking of a flat disc-shaped blank from the strip material.

The method and apparatus of the present invention preferably is utilized in conjunction with a double action press, some examples of which are shown and described in U.S. Pat. Nos. 3,902,348, 5,626,048, and 5,628,224. However, if desired the method and apparatus can also be utilized in conjunction with a single action press without affecting the concept of the invention. The main features of press 1 are shown in FIG. 1 and are described briefly below and include an inner ram 3 and an outer ram 5, only portions of which are shown in FIG. 1.

A usual punch core 8 also referred to as a draw horn, is connected to the lower end of a punch riser 4 which is reciprocated by inner ram 3. An inner pressure sleeve 9 (FIG. 2) and a concentrically located outer punch shell 10 surround punch core 8 and are reciprocated by inner ram 3 and independently moved by pneumatic cylinders 6 and 7, respectively. An outer pressure sleeve 12 extends concentrically about punch shell 10 and is reciprocally moved by a piston 13 controlled by movement of outer ram 5. A cut ring 15 is mounted on outer ram 5 by a cut ring retaining sleeve 16 secured to outer ram 5, by a plurality of bolts 17.

Figure 12:
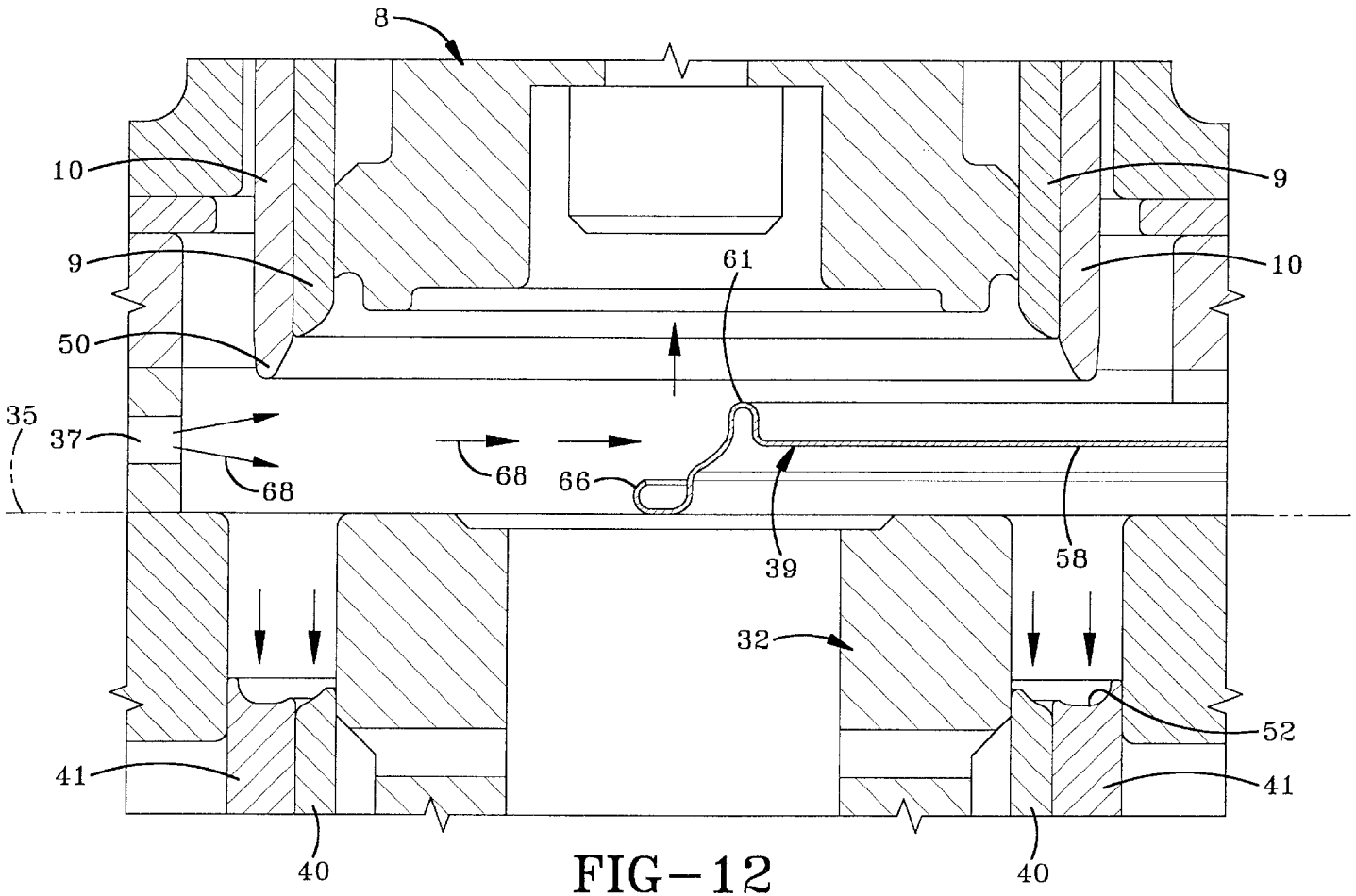
FIG. 12 is a view similar to FIG. 11 showing the end shell being ejected from the press at the second level.

A blank and draw die 20 is mounted by bolts 21 on a fixed base which is indicated generally at 23. A stock plate 24 is resiliently mounted by springs 25 or other type of cushioning means on base 23, for supporting a strip of material 26 as it is fed into the press for forming flat disc-shaped blanks 27 therefrom. When stock plate 24 is at its normal at-rest position aligned with annular top clamping surface 29 of blank and draw die 20, it will define a first level indicated by plane 30 (FIG. 1). A die core, indicated generally at 32, is fixedly mounted on base 23 and includes a flat planar top surface 33 which defines a second level indicated by plane 35. Blank and draw die 20 is formed with a die opening 36 which is in vertical alignment with top surface 33 of die core 32. An air passage 37 is formed in base 23 generally aligned with second level 35, and is connected to a source of pressurized air for ejecting finished end shells, indicated generally at 39, from the press as shown in FIG. 12. Inner and outer die core rings 40 and 41 respectively, are concentrically mounted about die core 32 and are independently moveable with respect to each other and to die core 32 by pneumatic cylinders 42 and 43 respectively.

Figure 2:
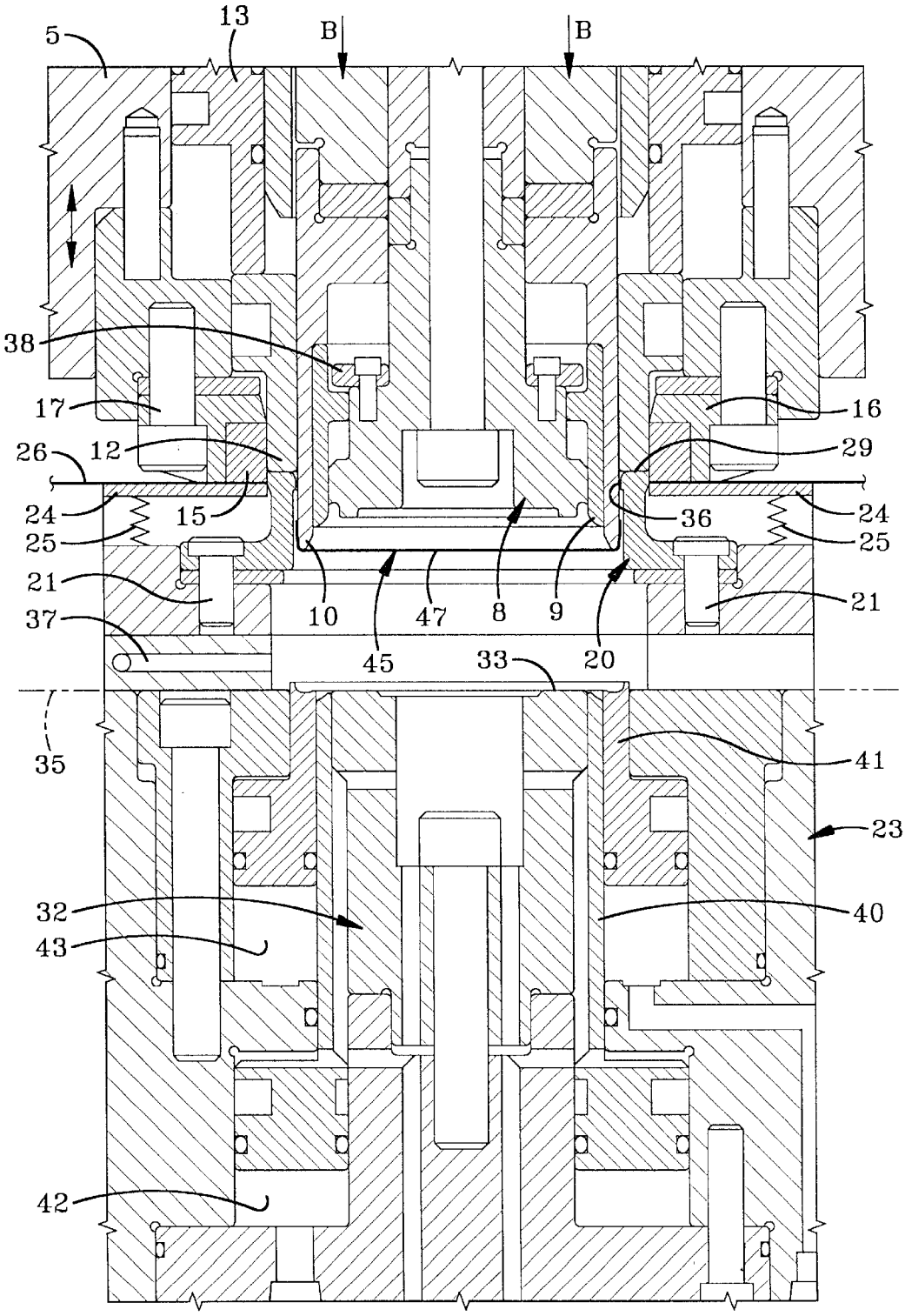
FIG. 2 is an enlarged view of a portion of FIG. 1 showing formation of the cup-shaped blank from the flat disc-shaped blank.
Figures 13, 14, 15, 16:
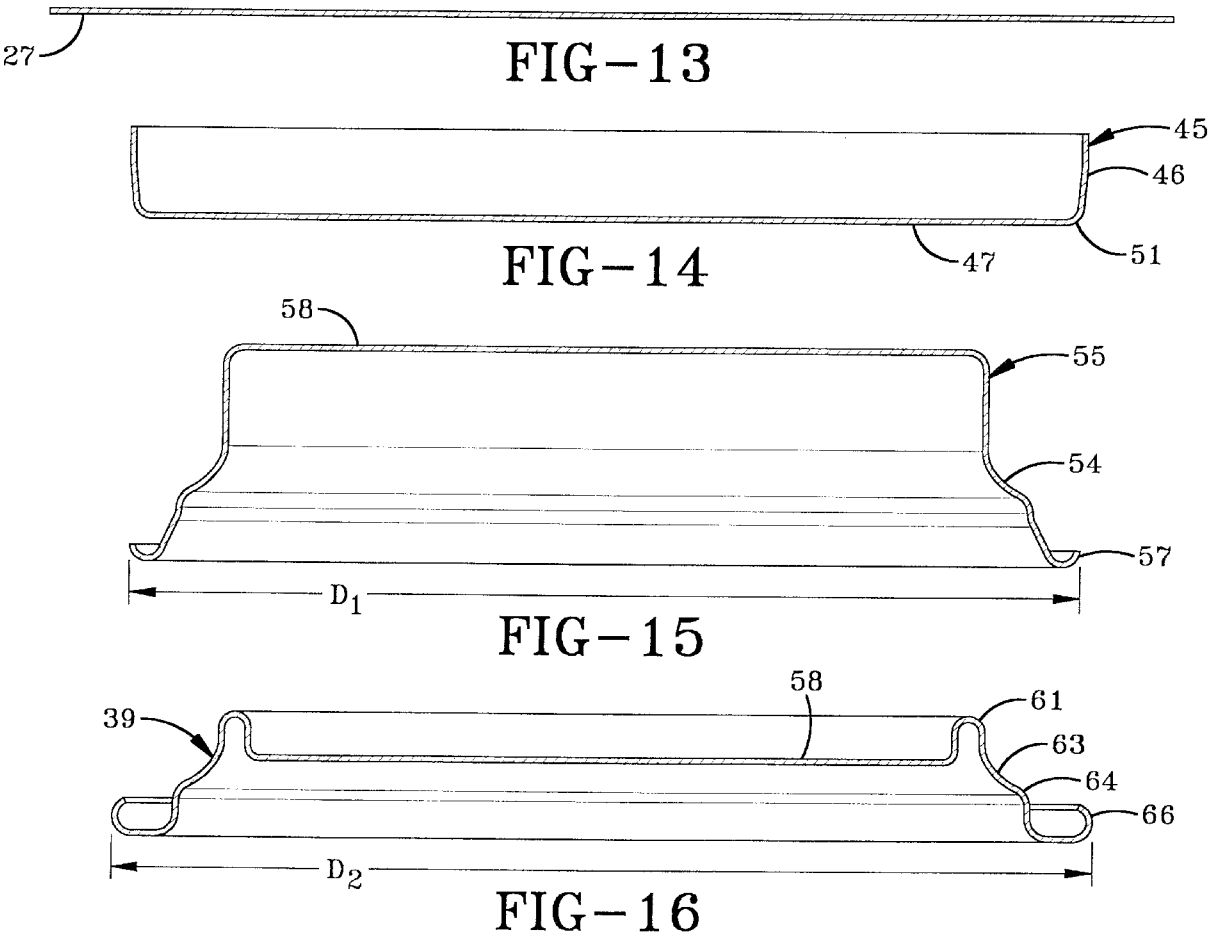
FIG. 13 is an enlarged sectional view of the flat disc-shaped blank produced by the tooling as shown in FIG. 1.
FIG. 14 is an enlarged sectional view showing the cup-shaped blank produced by the tooling as shown in FIG. 2.
FIG. 15 is an enlarged sectional view showing the partially formed end shell produced by the tooling as shown in FIG. 6.
FIG. 16 is an enlarged sectional view of the finished end shell having the peripheral curl as shown in FIG. 10.
Figure 17:
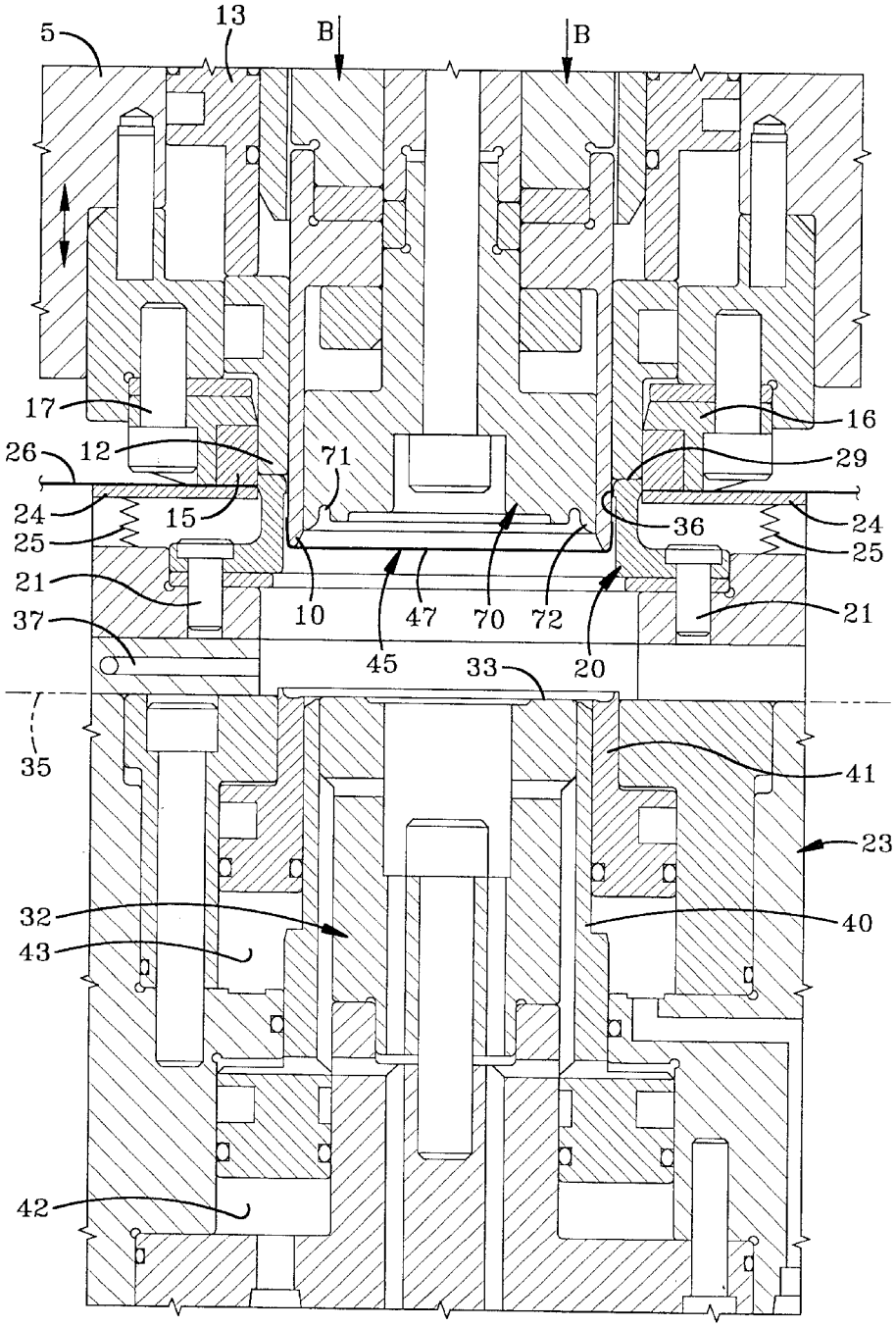
FIG. 17 is a view similar to FIG. 2 showing a modified apparatus and method for forming the end shell with the peripheral curl.
Figure 18:
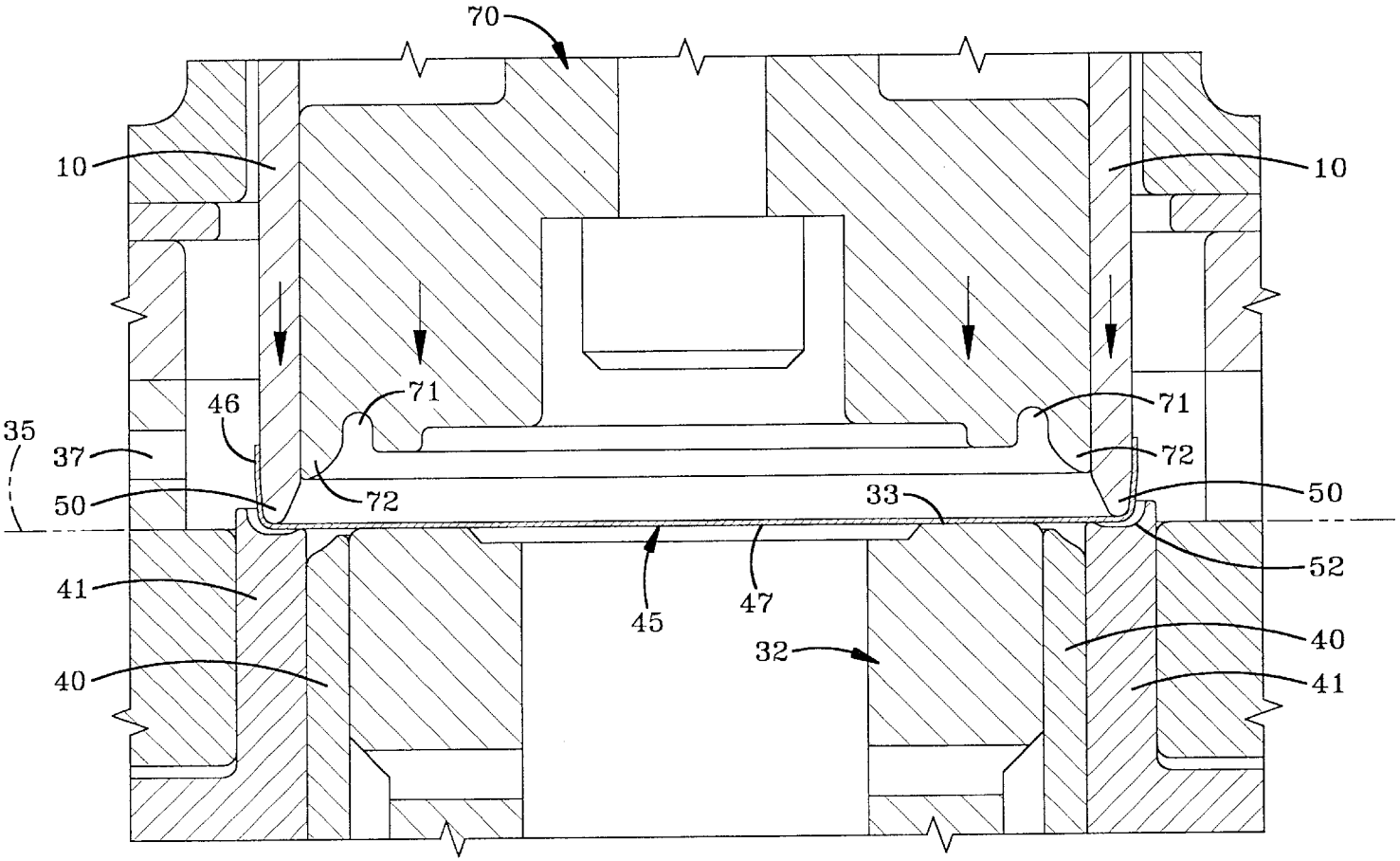
FIG. 18 is a view similar to FIG. 3 of the modified apparatus showing the cup-shaped blank at the second level.
Figure 19:
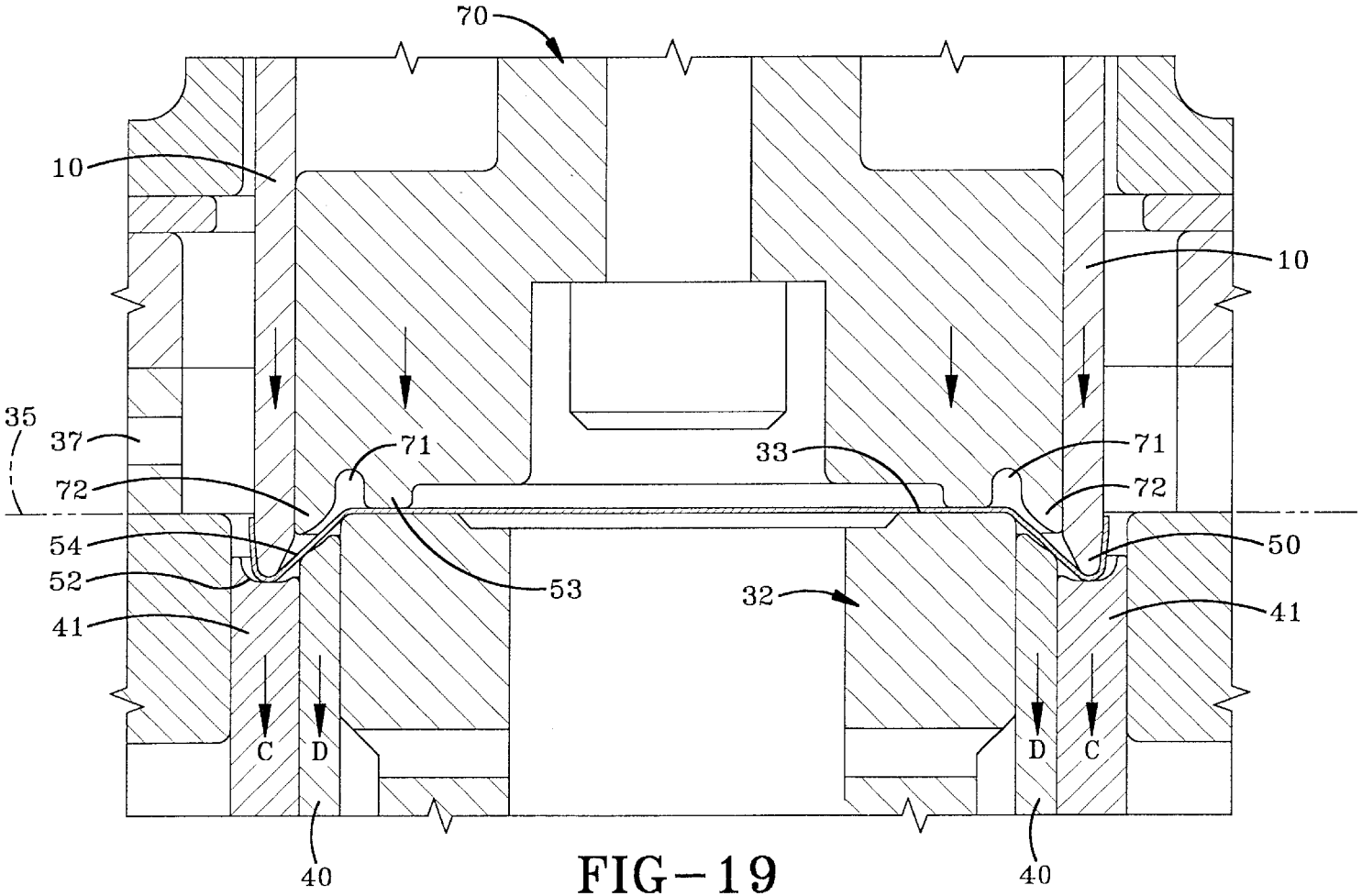
FIG. 19 is a view similar to FIG. 4 showing the modified apparatus starting the elongation of the chuckwall of the end shell blank.

In carrying out the method steps of the present invention, a strip of sheet material 26, such as lightweight aluminum, is fed into the press in the direction of arrow A (FIG. 1). Outer ram 5 moves cut ring 15 downwardly to sever a flat blank disc 27 from sheet 26 without requiring any prior clamping pressure being applied to the sheet material. Blank 27 is releasably clamped between outer pressure sleeve 12 and top surface 29 of blank and draw die 20. Inner ram 3 then moves downwardly in the direction of arrow B (FIG. 2) whereby punch shell 10 draws disc blank 27 through die opening 36 to form a shallow cup-shaped blank 45 which includes a cylindrical sidewall 46 and a flat bottom wall or panel 47 as shown in FIGS. 2 and 14.

Figure 3:
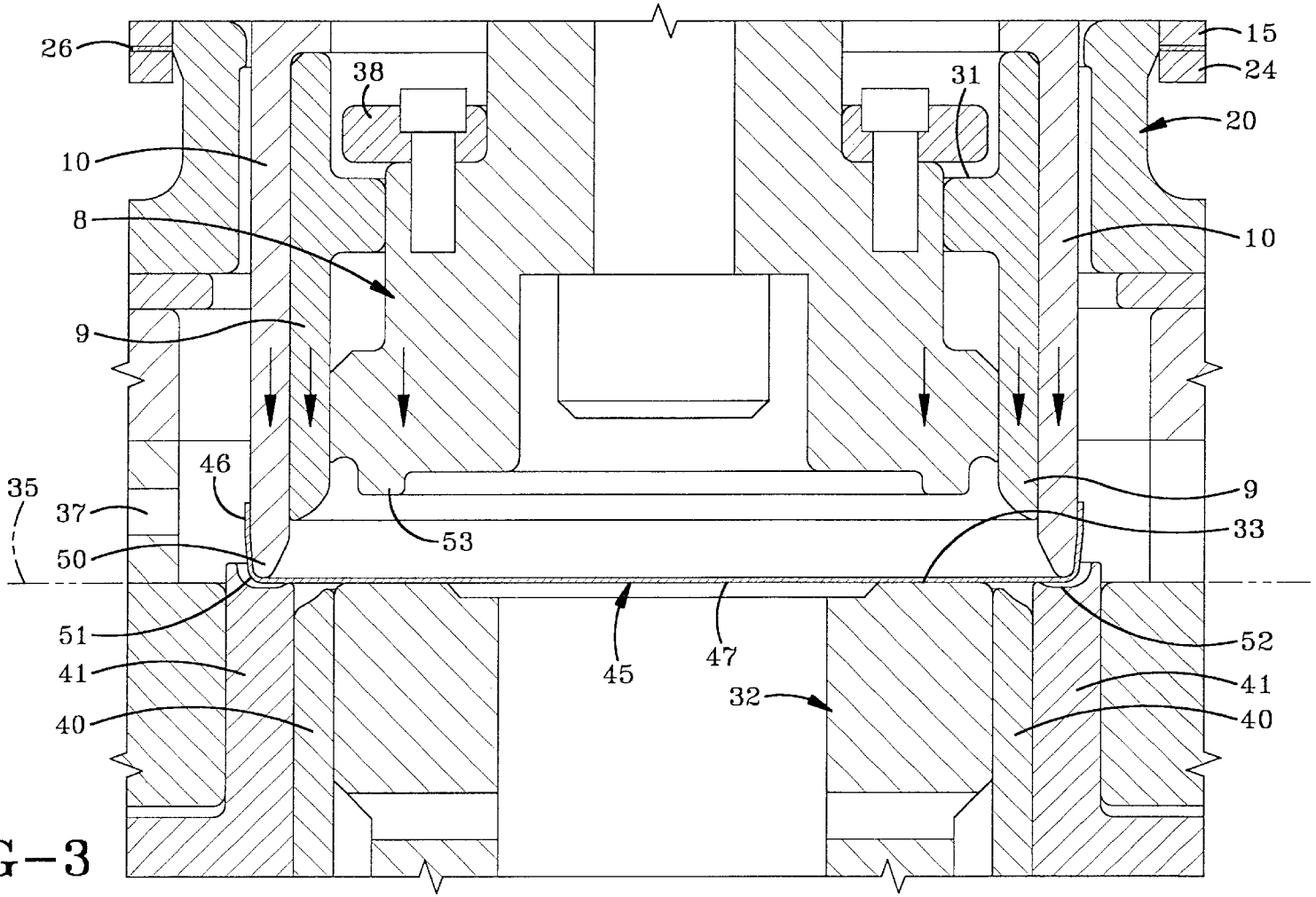
FIG. 3 is further enlarged fragmentary sectional view showing the formed cup-shaped blank moving to the second level of the press.
Figure 4:
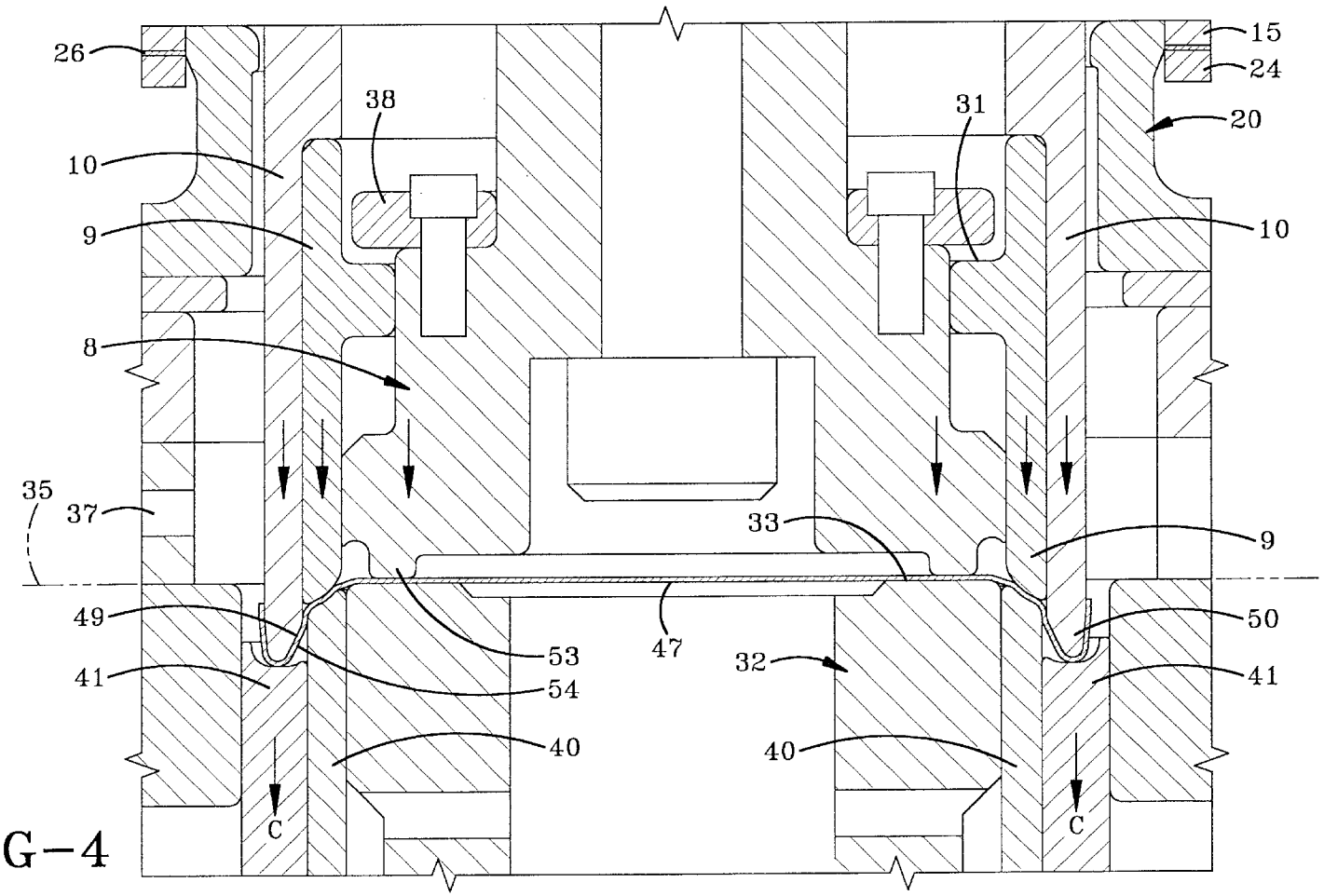
FIG. 4 is a view similar to FIG. 3 showing the start of forming of an elongated chuckwall of an end shell blank.
Figure 5:
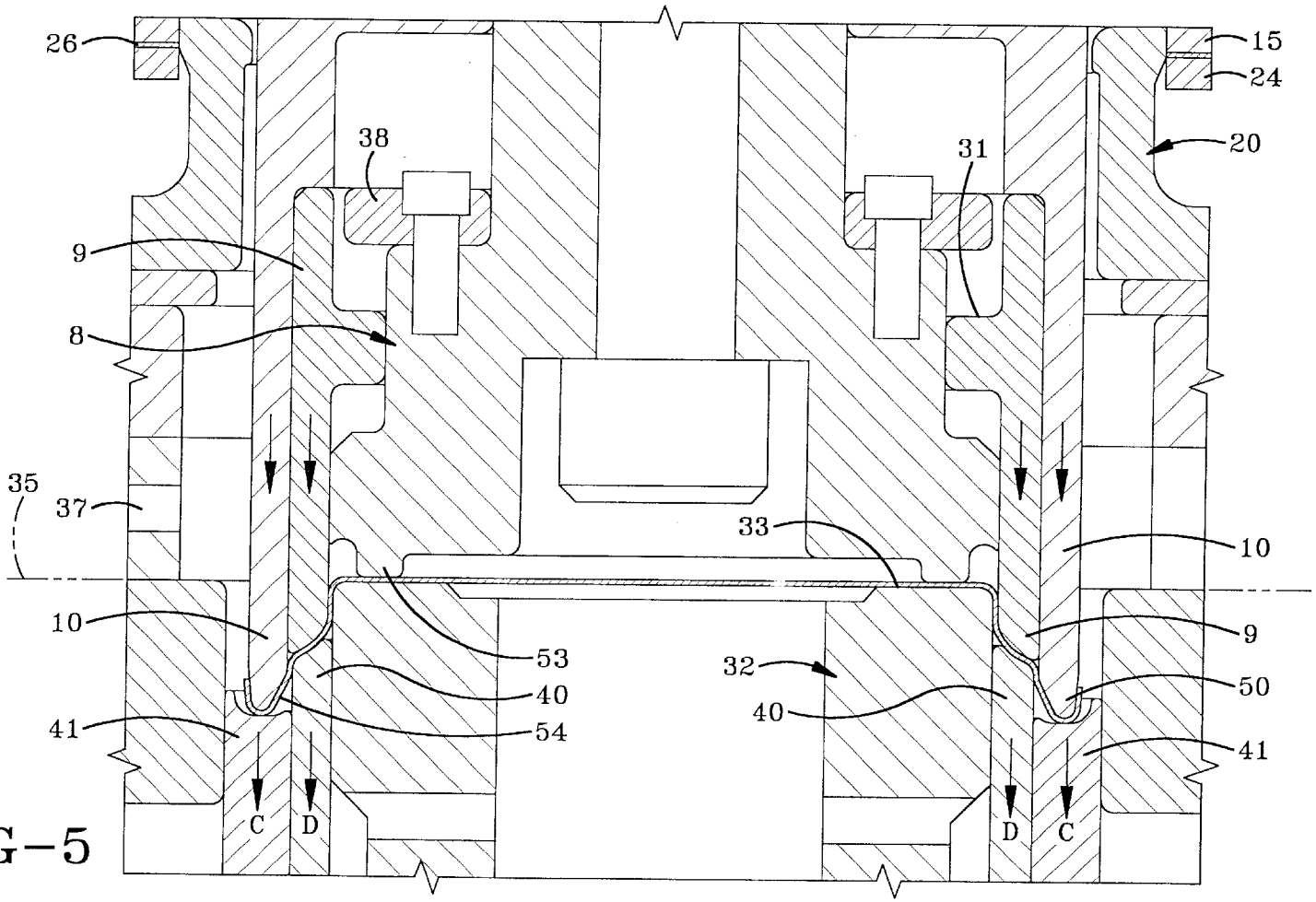
FIG. 5 is a sectional view similar to FIG. 4 showing the continued formation of the elongated chuckwall.
Figure 6:
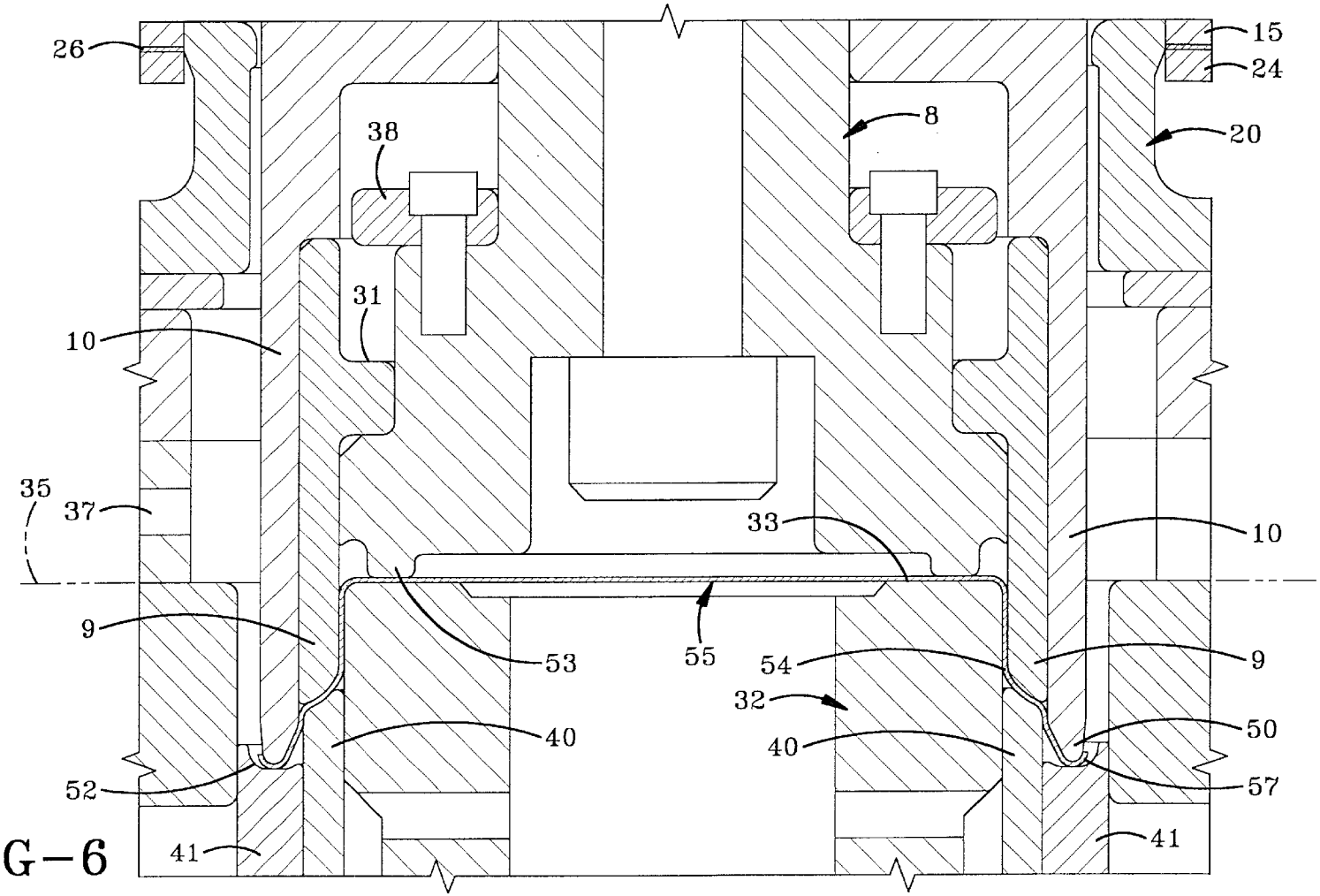
FIG. 6 is a view similar to FIGS. 4 and 5 showing the partially formed end shell at the bottom of the press down stroke.

Inner ram 3 continues to move punch shell 10, inner pressure sleeve 9, and punch core 8 downwardly through die opening 36 carrying cup 45 to second level 35 as shown in FIG. 3. Pressure sleeve 9 is carried downwardly by upper annular edge 34 thereof engaging an outwardly extending shoulder 28 formed on punch shell 10 until sleeve 9 and shell 10 reach the bottom of their stroke as shown in FIG. 6. Upon reaching second level 35, a rounded nose 50 of punch shell 10 will press annular outer corner 51 of cup 45 toward an annular curl forming groove 52 formed in an upper end of outer die core ring 41. Groove 52 has a considerably greater radius of curvature than rounded nose 50 as discussed below. As shown in FIG. 4, bottom panel 47 of cup 45 is moved against top surface 33 of die core 32 and clamped against surface 33 by an annular flat surface 53 formed on the outer end of punch core 8. Continued downward movement of punch shell 10 and inner pressure sleeve 9 will move outer and inner die core rings 41 and 40, respectively, downwardly as shown by arrows C and D (FIG. 5). This downward movement of inner pressure sleeve 9 and punch shell 10 will form an end shell blank having an elongated chuckwall 54 formed from portions of cylindrical sidewall 46 and outer portions of bottom panel 47 of cup 45 against a tapered surface 49 of nose 50. End shell blank 55 (FIG. 15) is formed upon pressure sleeve 9, punch shell 10, and inner and outer die core rings 40 and 41 reaching the bottom of the inner ram down stroke as shown in FIG. 6. Blank 55 includes elongated chuckwall 54 which terminates in a partially curled peripheral edge 57.

Figure 7:
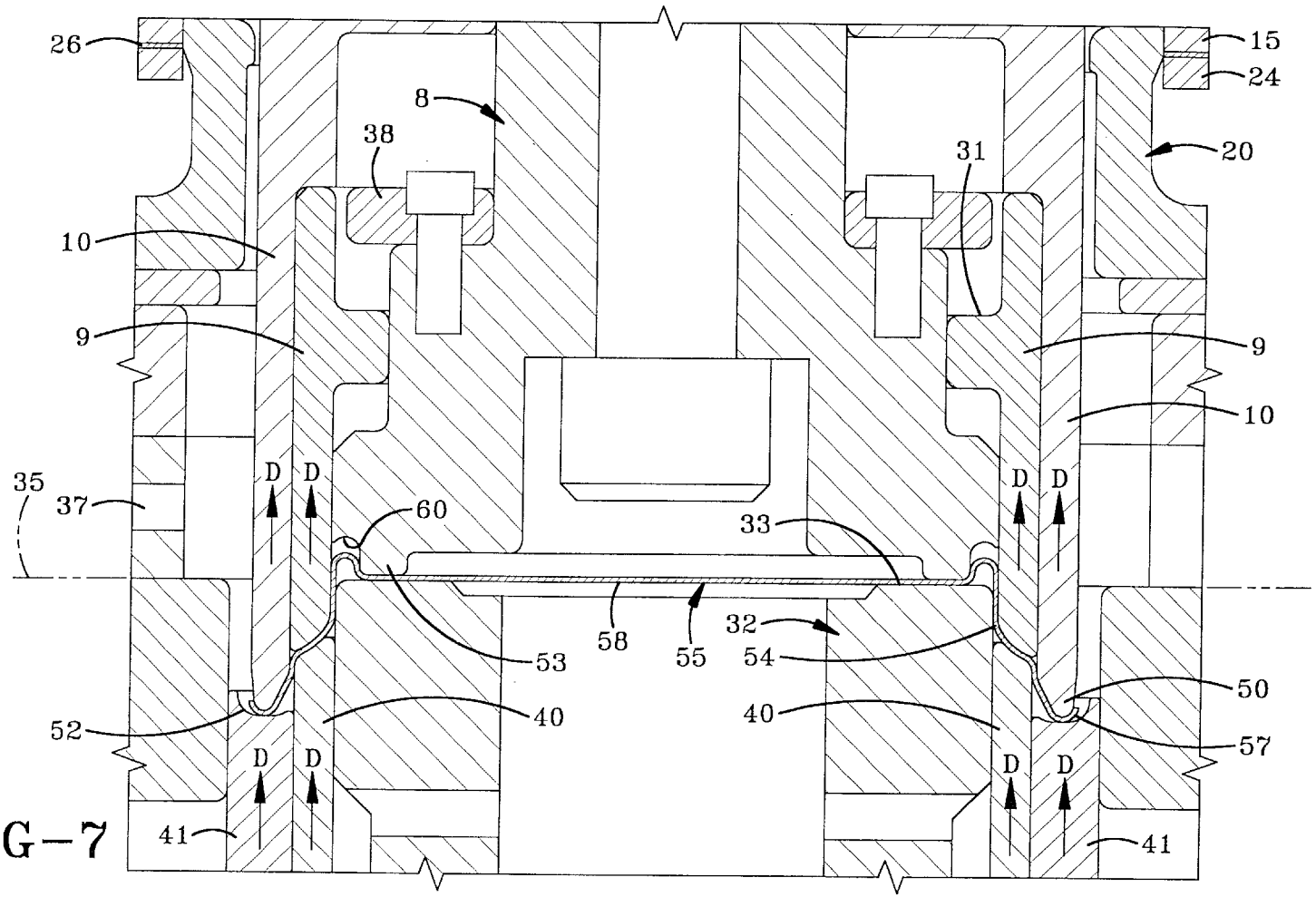
FIG. 7 is a view similar to FIG. 6 showing the start of forming the reinforcement rib in the end shell upon the return up stroke of the press.
Figure 8:
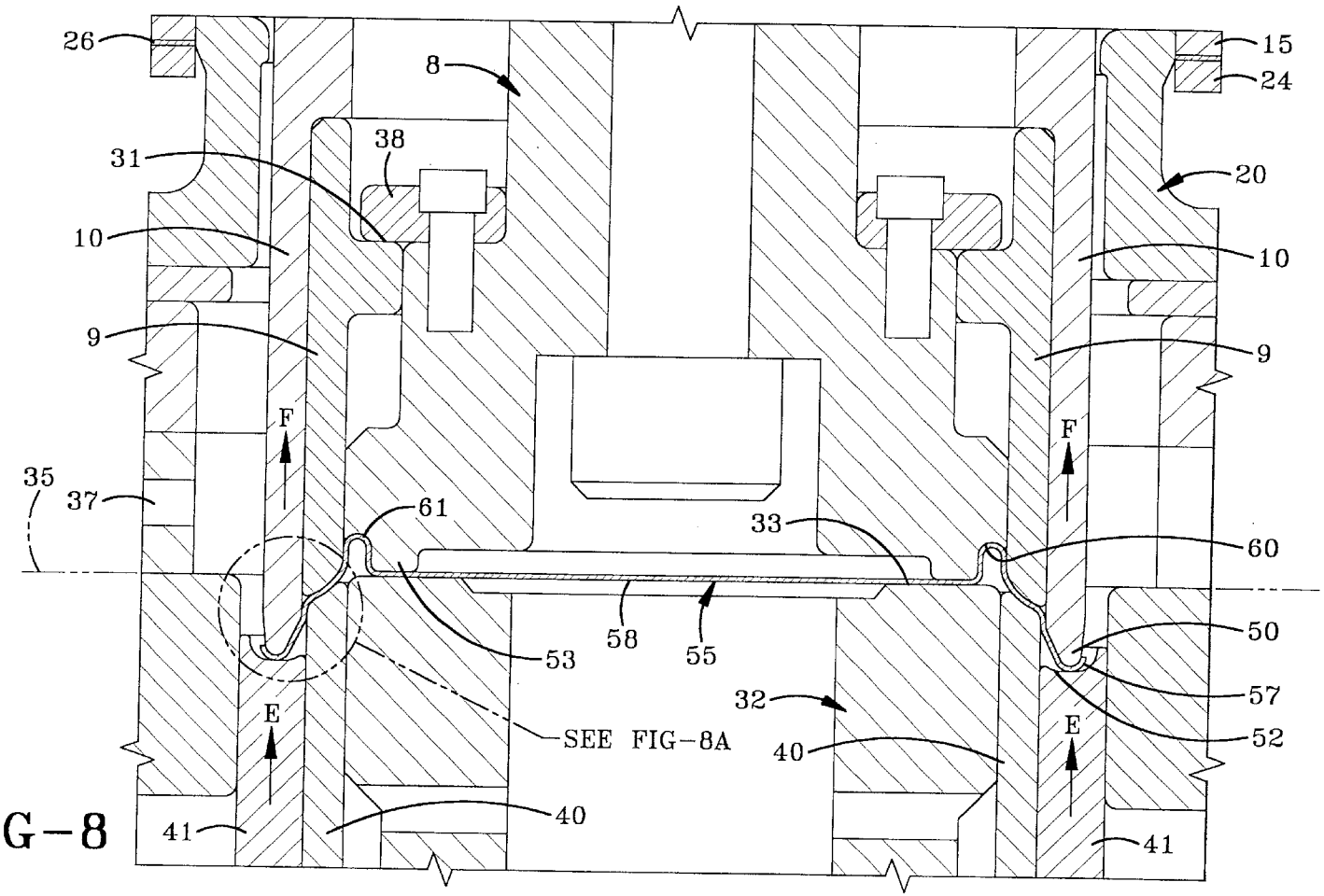
FIG. 8 is a view similar to FIG. 7 showing completion of the annular reinforcement rib just prior to formation of the peripheral curl.

After reaching the bottom of the down stroke as shown in FIG. 6, inner and outer die core rings 40 and 41 reverse their direction of movement and begin to move upwardly as shown in FIG. 7 by actuation of pneumatic cylinders 42 and 43 (FIG. 2), moving inner pressure sleeve 9 and punch shell 10 upwardly therewith as shown by arrows D. Punch core 8 remains in its lowermost position and maintains clamping pressure against bottom panel 58 of shell blank 55 against top surface 33 of die core 32. As shown in FIG. 8, an inwardly extending annular shoulder 31 of pressure sleeve 9 engages a stop ring 38 mounted on punch core 8 providing a positive stop and accurate positioning of sleeve 9 for the subsequent forming of curl edge 66.

In accordance with one of the features of the invention, a portion of the metal, which is indicated at 62 and located in the unclamped portion of elongated chuckwall 54 between inner die core ring 40 and annular rib 53 of punch core 8 (FIG. 6), is pushed into a female die component formed in the outer periphery of punch core 8 which forms an annular outer groove 60. Upon completion of the upward movement of inner die core ring 40 as shown in FIG. 8, an annular reinforcing rib 61 is formed in bottom panel 58 of shell blank 55 by movement of the unclamped metal into groove 60 which functions as a female die component. This formation of rib 61 without the use of a mating male die component prevents thinning and wrinkling of the metal. Also, this female die component or groove exactly matches the desired contour, shape, size, etc. of rib 61 in contrast to other rib forming grooves which do not provide this exact matching feature.

Figure 8A:
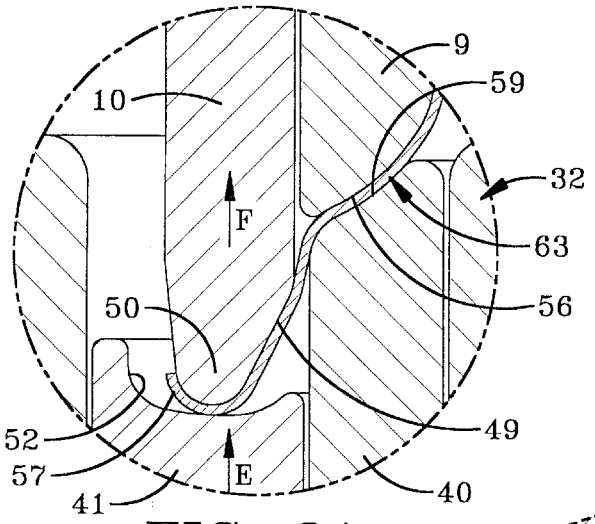
FIG. 8A is an enlarged view of the encircled portion of FIG. 8.

Outer die core ring 41 continues its upward movement as shown by arrow E (FIG. 8), moving punch shell 10 with it as shown by arrow F, while rounded nose 50 of punch shell 10 maintains a releasable clamping engagement with the partially curled peripheral edge 57 of shell blank 55 in curl forming groove 52 of outer die ring core 41, as shown in FIG. 8A. Inner die core ring 40 and pressure sleeve 9 remain in position by engagement of shoulder 31 with stop ring 38.

Figure 9A:
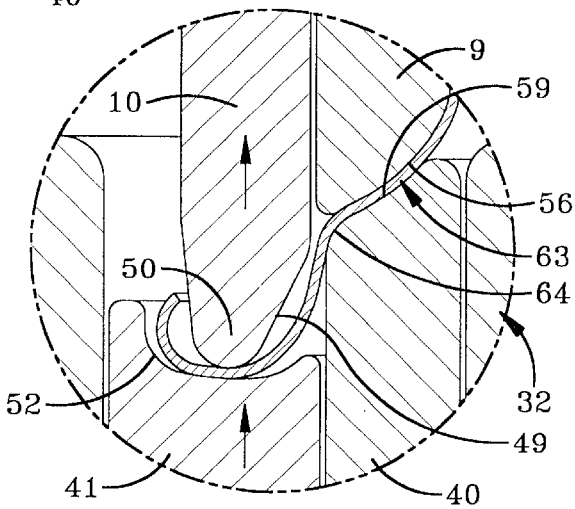
FIG. 9A is an enlarged view of the encircled position of FIG. 9.
Figure 10A:
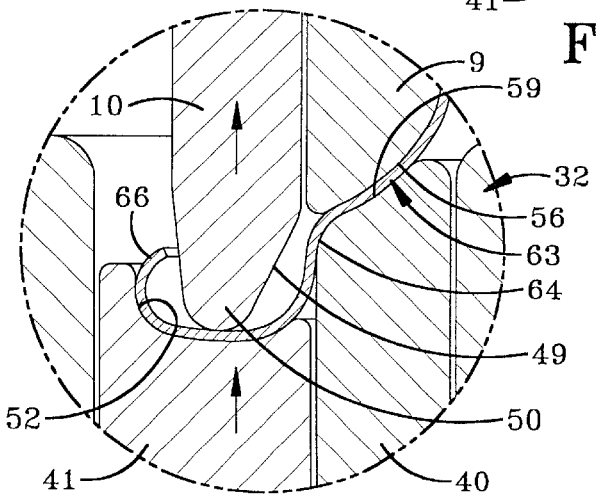
FIG. 10A is an enlarged view of the encircled position of FIG. 10.
Figure 8A:
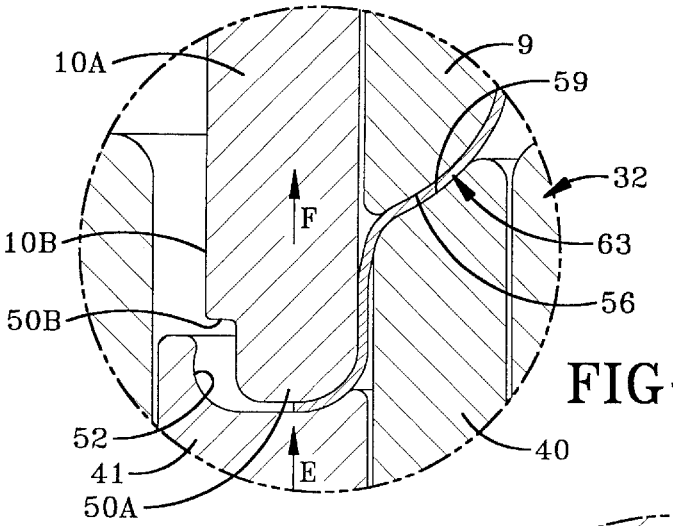
Figure 9A:
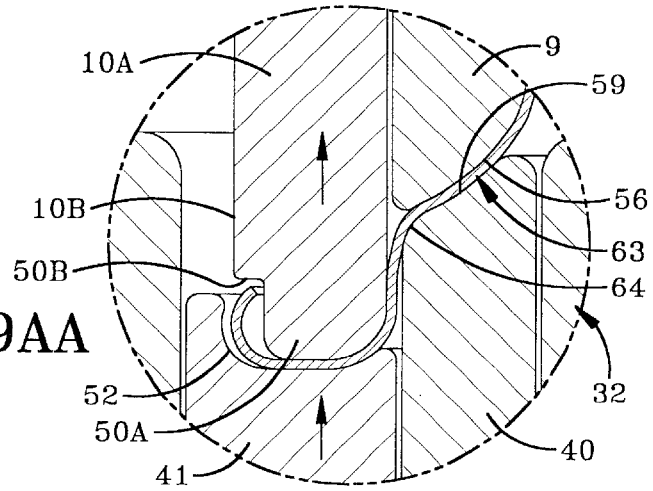
Figure 10A:
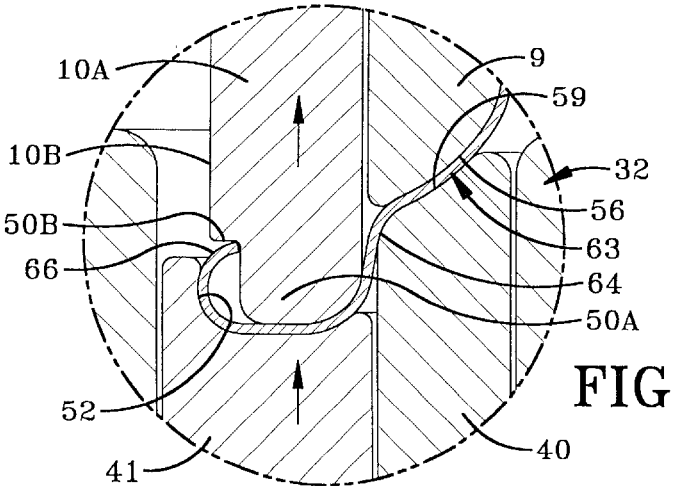
Figure 9:
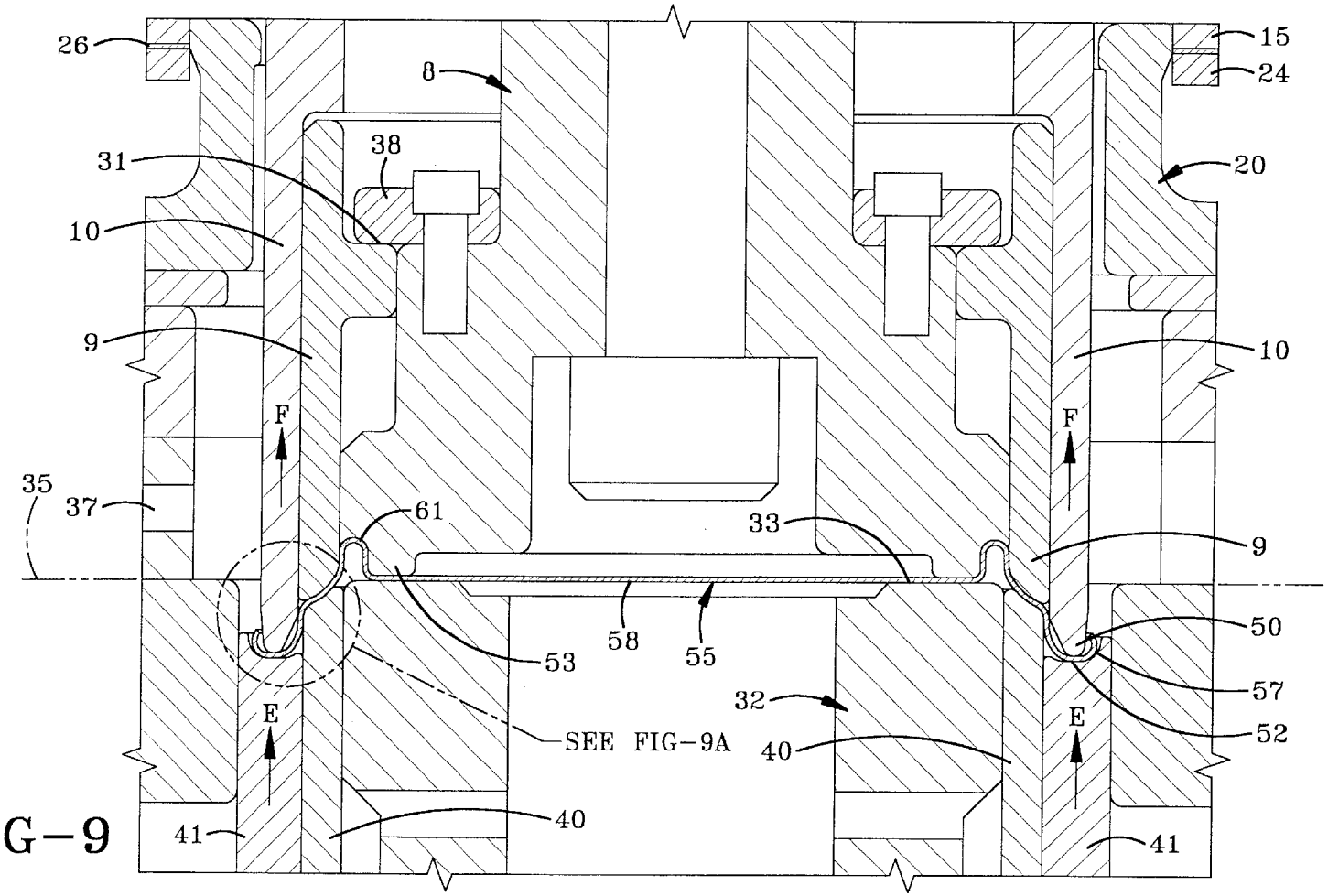
FIG. 9 is a view similar to FIG. 8 showing the start of forming the peripheral curl.
Figure 10:
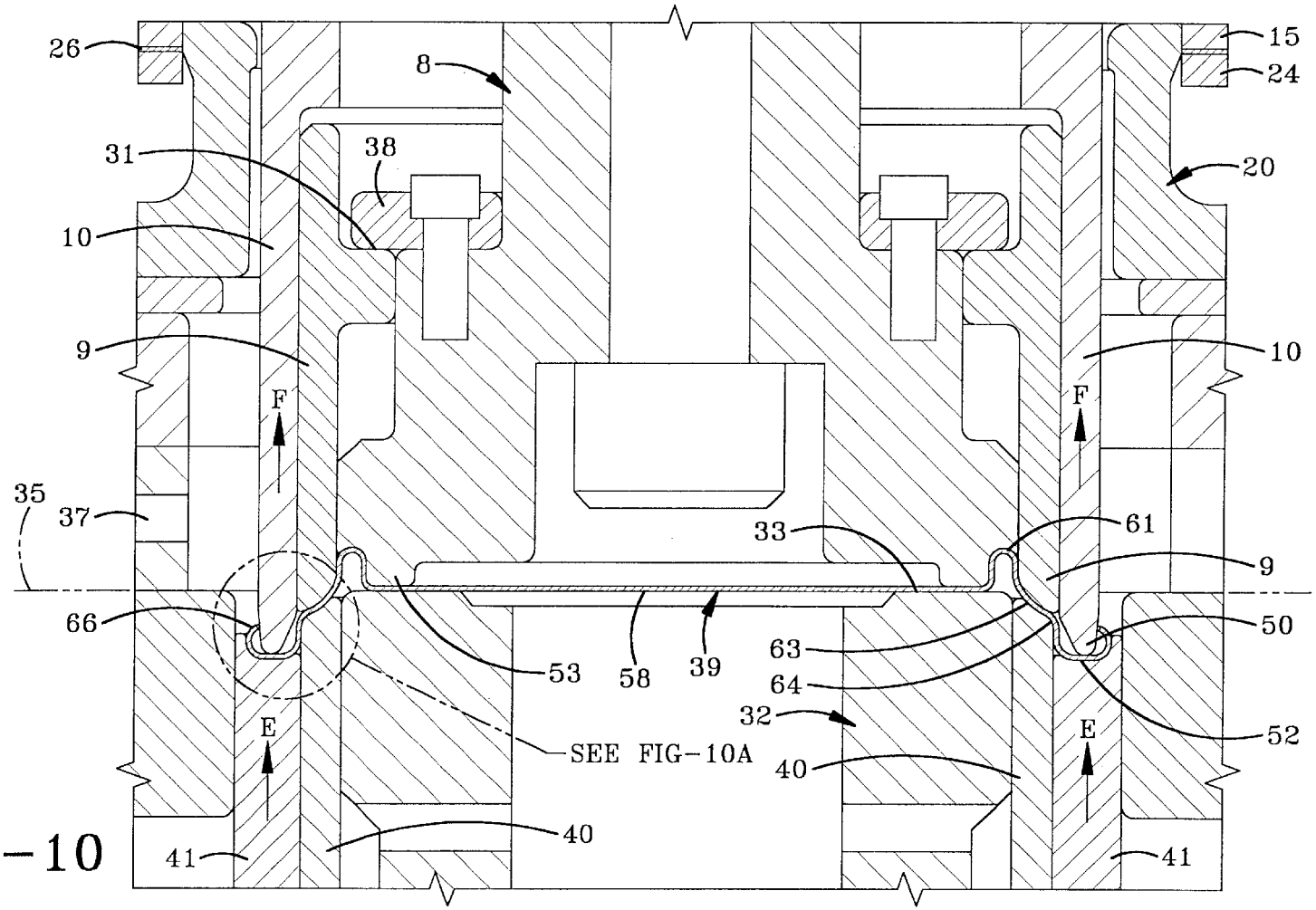
FIG. 10 is a view similar to FIGS. 8 and 9 showing completion of the peripheral curl.

In accordance with another feature of the invention, continued upward movement of outer die core ring 41 in the direction of arrow E (FIG. 8) forms the desired peripheral curl on shell blank 55 as shown in FIGS. 9 through 10AA and described below. As outer die core ring 41 continues to move upwardly, an annular area 63 of elongated chuckwall 54 (FIGS. 8A, 9A, and 10A) is maintained in a secure clamped position between opposed stationary curved outer surfaces 56 and 59 of inner pressure sleeve 9 and inner die core ring 40 respectively, which causes the unclamped outer portion of chuckwall 54 to pivot about a curved area 64 from the position of FIG. 8A to that of FIG. 10A. During this pivoted movement the material passes through the releasably clamped area between rounded nose 50 and curl forming groove 52 as shown in FIGS. 9A and 10A, whereby partially curled edge 57 will follow the general contour of groove 52 which will cause the metal to curl back upon itself until it reaches the desired final peripheral curl configuration 66 as shown in FIG. 10A.

As punch shell 10 and die core ring 41 move upwardly, the natural inherent tendency of the metal in partially curled edge 57 is to continue to turn inwardly as it moves about the larger radius of surface 52 to form the desired peripheral curl 66. Since the chuckwall is securely clamped at area 63 between pressure sleeve 9 and inner die core ring 40, this upward movement of punch shell 10 and die core ring 41 requires the metal to move outwardly which results in the formation of curl 66. Outer die core ring 41 continues to move upwardly in the direction of arrow E as shown in FIGS. 10 and 11 after formation of peripheral curl 66, continuing to move punch shell 10 upwardly as shown by arrow F.

Figure 11:
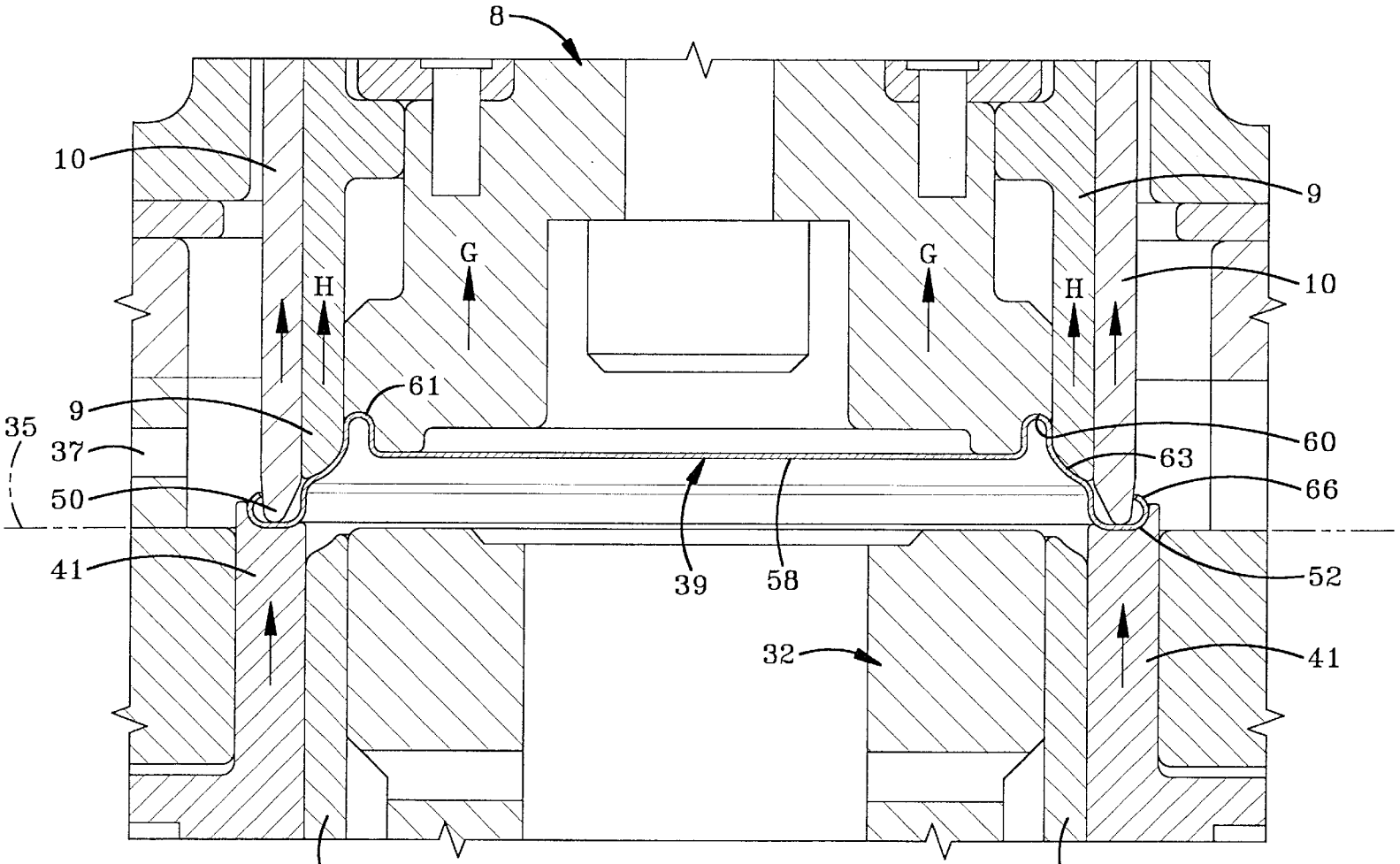
FIG. 11 is a view similar to FIG. 10 showing the formed end shell being moved back to the second level for subsequent ejection from the press.

Immediately after completion of forming peripheral curl 66, punch core 8, and inner pressure sleeve 9 will also move upwardly in the direction of arrows G and H as shown in FIG. 11, which will release the clamping engagement of end shell 39 with die core 32 and inner die core ring 40. This enables outer die core ring 41 to raise the formed end shell 39 to discharge level 35 at which location in the stroke cycle, a blast of pressurized air indicated by arrow 68 (FIG. 12), is released through air passage 37 to discharge end shell 39 from press 1 at level 35. Preferably shell 39 is discharged from the press in the same direction as is the incoming material feed direction. The finished end shell can then be deposited into a hopper, conveyor, or other equipment for transportation to storage or additional processing.

Another feature of the invention, as shown in FIGS. 15 and 16, is that the overall outer diameter $D_1$ of preliminarily formed end shell blank 55 is increased when forming the peripheral curl as shown by larger diameter $D_2$ of end shell 39. In all known prior edge curl forming apparatus, the preliminarily formed curl is moved inwardly to form the final peripheral curl, decreasing the overall diameter of the end shell. In the present invention, this increase in overall diameter is achieved by the rotation of the outer portion of the elongated chuckwall 54 about a pivot area 64 as shown in FIGS. 8A, 9A, and 10A and discussed above.

A slightly modified punch shell 10A is shown in FIGS. 8AA–10AA. In this embodiment, modified punch shell 10A is formed with a more rounded nose 50A than nose 50 described above, and is void of the tapered surface 49. Most importantly, a shoulder 50B is formed in an outer edge 10B of punch shell 10A. Shoulder 50B provides a positive stop for controlling the curvature and amount of pivotal movement of the metal during formation of peripheral curl 66. As the metal moves about nose 50A and along curl forming groove 52, it will engage shoulder 50B, as shown in FIG. 10AA, which provides for the desired configuration of the peripheral curl to insure consistency therein as the curls are formed in the end shells.

Thus, the improved apparatus and method of the present invention enables an end shell to be formed with a peripheral curl at a single station of a press and in a single press cycle by forming a partially formed end shell 55 (FIG. 15) upon completion of the downstroke of the inner ram, with the final peripheral curl being formed upon the upstroke of the inner ram and reverse movement of the inner and outer die core rings. Futhermore, disc-shaped blanks 27 are formed at first level 30 and then moved to second level 35 for subsequent formation of the peripheral curl and ejection from the press providing increased production speed by eliminating the need to raise the finished end shell back to the first level for ejection. This two level feature also avoids any contact or coordination with the movement of the incoming sheet material 26.

A slightly modified form of the apparatus of the present invention is shown in FIGS. 17–23. A main difference in this modified apparatus is providing punch core 70 with an annular groove 71 that is spaced inwardly from the outer periphery of the punch core and the elimination of inner pressure sleeve 9. Groove 71 forms an outer rounded nose 72 which has a similar contour and functions in a similar manner as did inner die sleeve 9 of the first embodiment described above. As particularly shown in FIG. 22, outer rounded nose 72 of die core 70 clamps area 63 of chuckwall 54 against the upper rounded surface of inner die core ring 40 in the same manner as inner pressure sleeve 9 and retains a clamping engagement therewith as outer die core ring 41 moves upwardly in the direction of arrow E to form peripheral curl edge 66.

Figure 20:
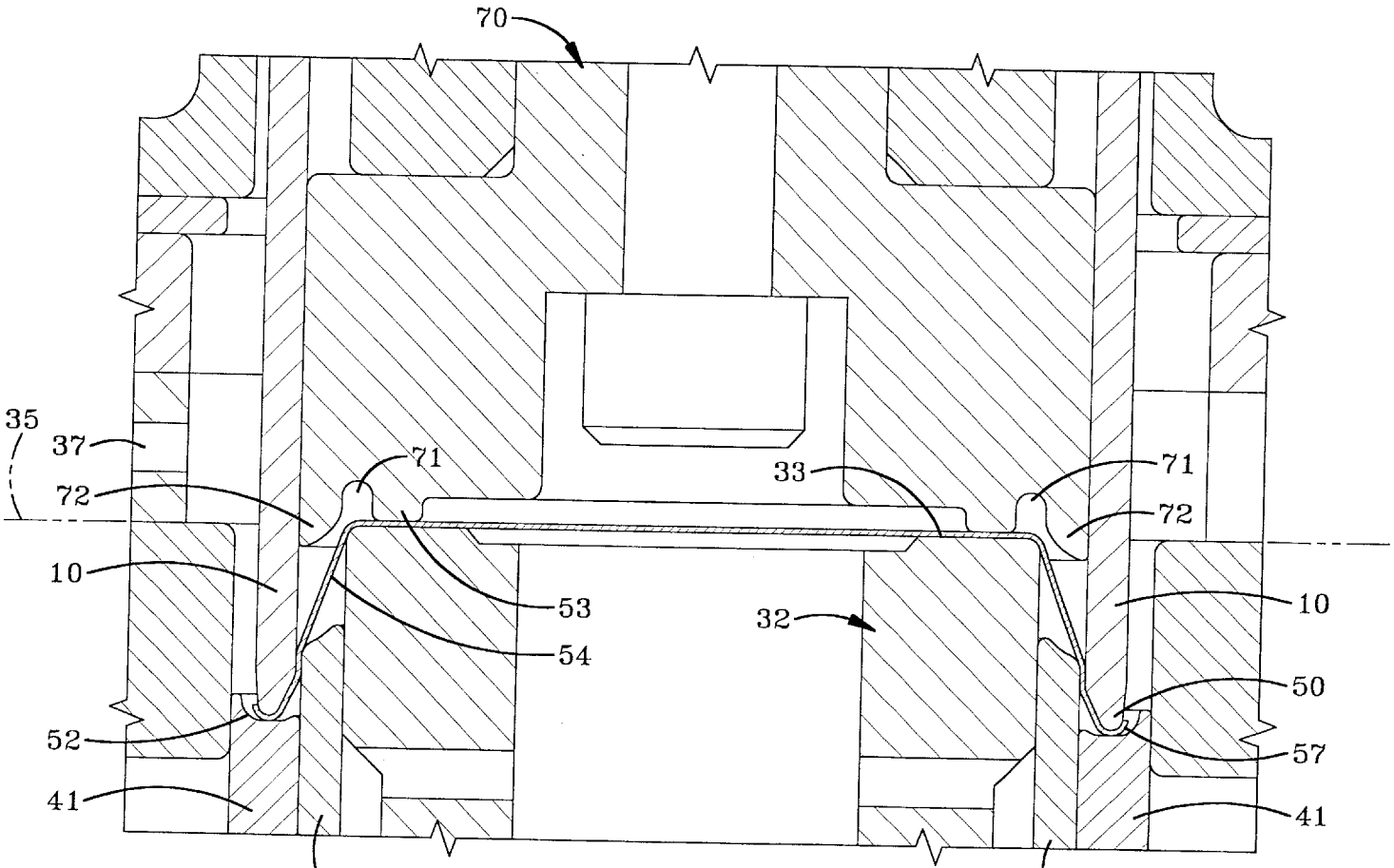
FIG. 20 is a sectional view similar to FIG. 6 showing the modified apparatus at the bottom of the down stroke.
Figure 21:
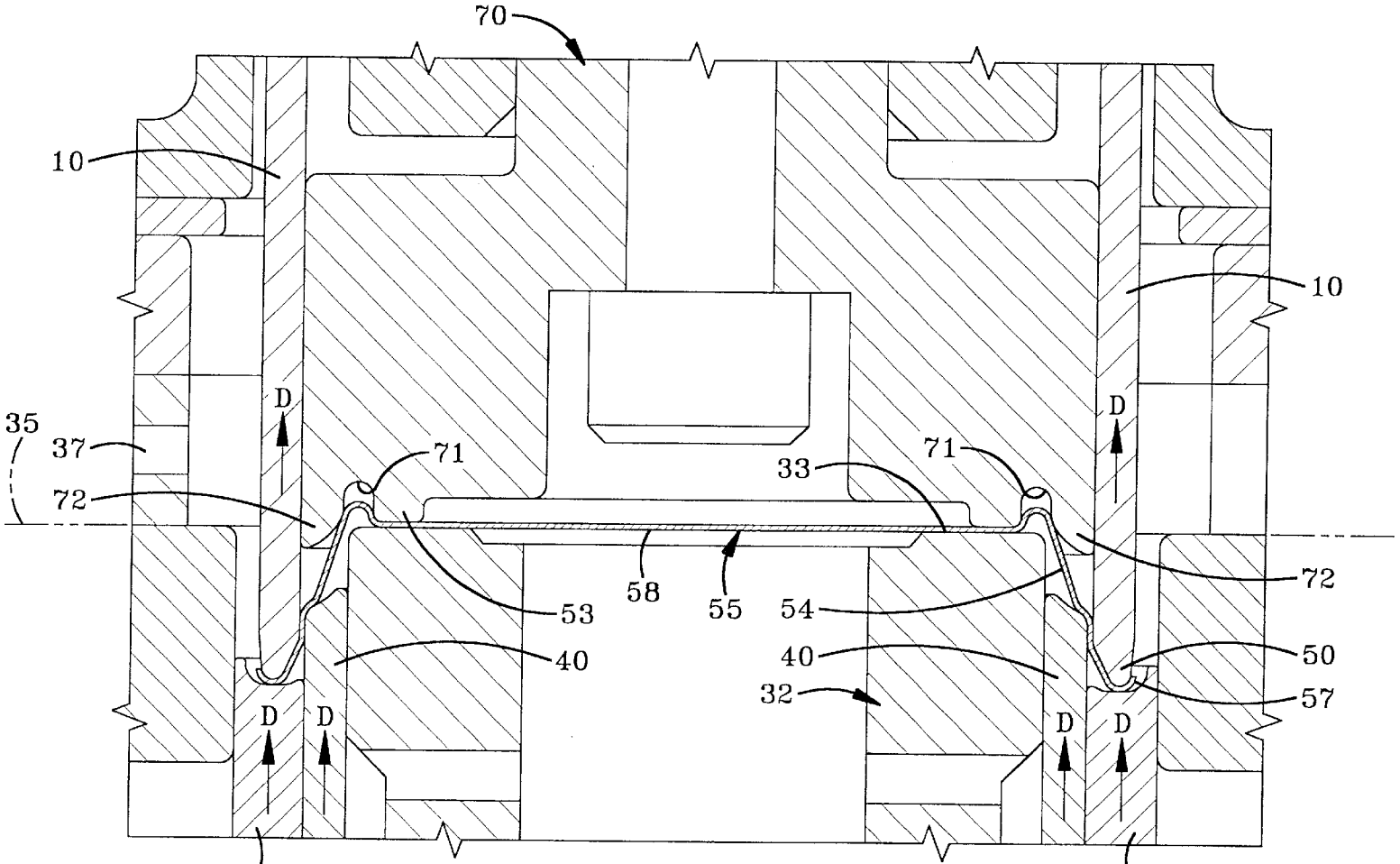
FIG. 21 is a sectional view similar to FIG. 7 showing the start of forming the reinforcement rib in the end shell by the modified apparatus.
Figure 22:
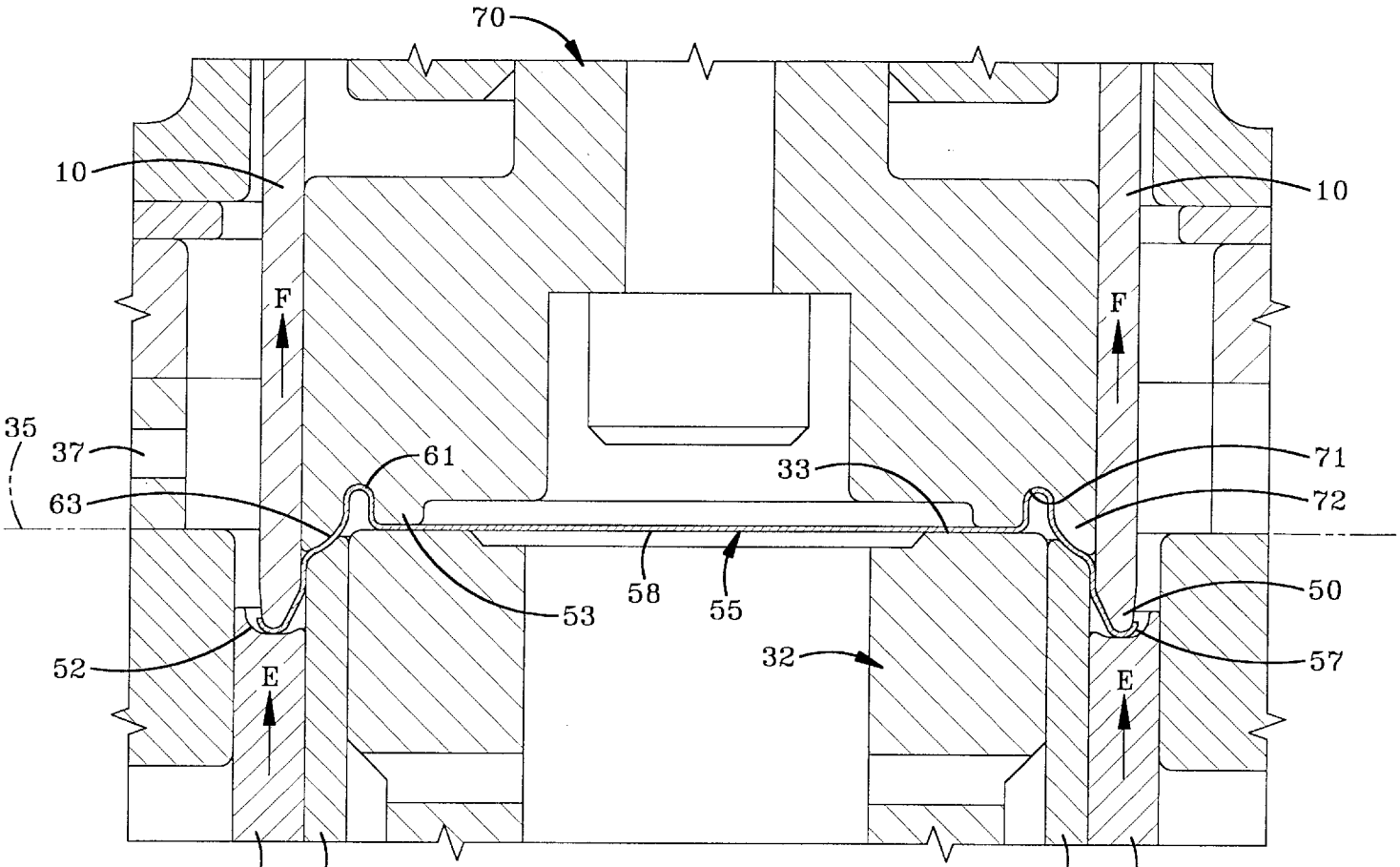
FIG. 22 is a view similar to FIG. 8 showing the modified apparatus at the start of forming the peripheral curl on the partially formed end shell.
Figure 23:
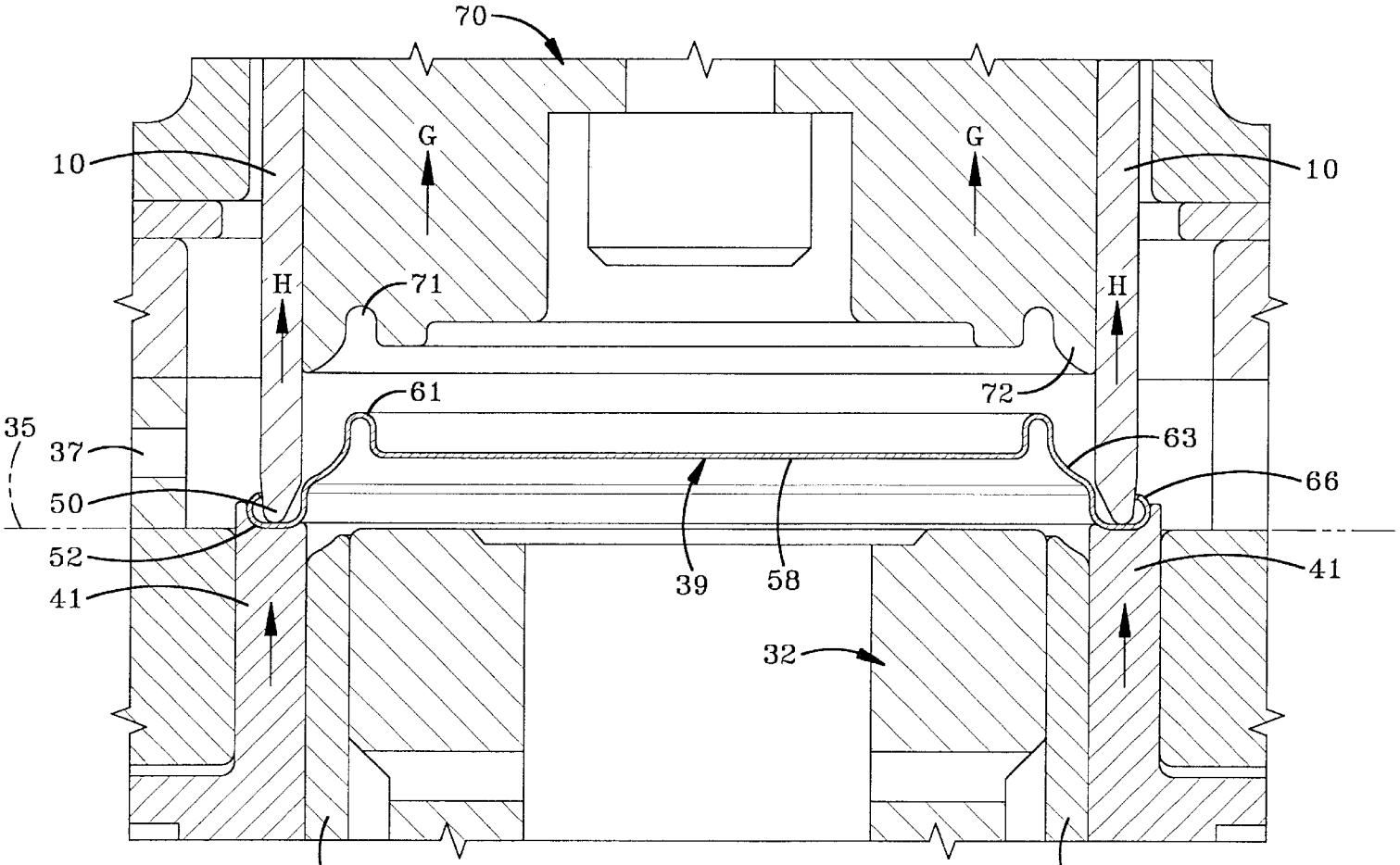
FIG. 23 is a view similar to FIG. 11 showing the formed end shell with the peripheral curl raised to the second level prior to ejection from the press.

In the same manner as shown in FIGS. 8A–10A, outer reinforcing rib 61 is formed in annular groove 71 as inner and outer die core rings 40 and 41 move upwardly as shown in FIGS. 20 and 21. The finished end shell 39 is ejected in a similar manner by pressurized air from air passage 37 as the shell is raised to the second level 35 as shown in FIG. 23 after punch shell 10 has been raised out of clamping engagement with the peripheral curl and punch core 70 moves out of clamping engagement against panel 58.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

What is claimed is:

1. A method of forming an end shell having a peripheral curl for use on a container in a press from sheet material, including the steps of:

cutting a flat blank from the sheet material at a first level;

forming a cup-shaped blank having a bottom panel and a sidewall by drawing the flat blank through a blank and draw die;

trapping an outer portion of the cup-shaped blank between a curl groove of an outer die core ring and a punch shell;

clamping the bottom panel between a punch core and a die core at a second level;

forming an end shell blank having an elongated chuckwall from the cup-shaped blank by advancing the punch shell and outer die core ring below the second level;

reversing the direction of movement of the outer die core ring and punch shell to draw a peripheral edge of the chuckwall about the curl groove to form the peripheral curl on said end shell;

continuing to advance the outer die core ring and punch shell in the reverse direction of movement to raise the end shell to adjacent the second level;

retracting the punch core to release the clamping of the bottom panel; and discharging the end shell from the press at the second level.

2. The method defined in claim 1 including the step of releasably clamping the flat blank between an outer pressure ring and the blank and draw die after forming the flat blank from the sheet of material.

3. The method defined in claim 1 including the step of forming the elongated chuckwall of the end shell blank by drawing material from the sidewall and bottom panel of the cup-shaped blank.

4. The method defined in claim 1 including the step of clamping a portion of the chuckwall between an inner pressure sleeve and an inner die core ring while drawing the peripheral curl on the end shell.

5. The method defined in claim 1 including the step of providing the press with inner and outer rams; and moving the punch core and punch shell by the inner ram.

6. The method defined in claim 1 including the step of mounting the die core in a fixed position on a base.

7. The method defined in claim 1 including the step of releasably clamping the peripheral edge of the chuckwall between the punch shell and outer die core ring during the step of drawing said peripheral edge about the curl groove to form the peripheral curl.

8. The method defined in claim 1 including the step of increasing an outer diameter of the end shell when drawing said peripheral edge about the curl groove to form the peripheral curl.

9. The method defined in claim 1 including the step of discharging the formed end shell from the press in the same direction as the direction of feed of the sheet material into the press.

10. The method defined in claim 1 including the step of providing the punch core with an outer annular nose for clamping a portion of the chuckwall against an inner die core ring while forming the peripheral curl on the end shell.

11. The method defined in claim 1 including the step of providing the punch shell with a rounded end; and providing the curl groove in the outer die core ring with a radius of curvature greater than a radius of curvature of the punch shell rounded end.

12. The method defined in claim 1 including the step of pushing a portion of the end shell blank into an annular reinforcement groove formed in the punch core free of any mating male die component to form an annular reinforcing rib on the end shell during the step of reversing the direction of movement of the outer die core ring and punch shell.

13. The method defined in claim 12 including the step of clamping a portion of the elongated chuckwall between an inner pressure sleeve and an inner die core ring; and moving said inner pressure sleeve and inner die core ring with the outer die core ring and punch shell in the reverse direction when pushing a portion of the end shell blank into the reinforcement groove to form the reinforcing rib.

14. The method defined in claim 13 including the step of the inner die core ring engaging a stop on the punch core to stop the reverse movement of said inner die core ring during the step of drawing of the peripheral edge of the chuckwall about the curl groove.

15. Apparatus for forming an end panel having a peripheral curl in a press having inner and outer rams comprising:

a punch core and a punch shell reciprocally movably carried by the inner ram;

a blank and draw die carried by a base and defining a first level;

a die core carried by the base in opposed relationship to the punch core and defining a second level;

inner and outer die core rings reciprocally movably mounted on the base in concentric relationship with said die core, said outer die core ring being in opposed relationship to the punch shell and having an outer curl groove formed therein;

said punch shell being movable through the blank and draw die to form a cup-shaped blank and to releasably clamp an outer portion of said cup-shaped blank in the curl groove of the outer die ring to form an end shell having an elongated chuckwall by movement of said punch shell and outer die core ring beyond the second level; and said inner die core ring being adapted to clamp a portion of the chuckwall as the outer die core ring and punch shell draws the peripheral curl in the end shell upon reversing the direction of movement of said punch shell and outer die ring.

16. The apparatus defined in claim 15 wherein the die core is fixedly mounted on the base.

17. The apparatus defined in claim 15 wherein a cut edge is mounted on the outer ram for forming a disc-shaped blank from a sheet of material.

18. The apparatus defined in claim 15 in which the punch shell has a rounded nose and has a radius of curvature less than a radius of curvature of the curl groove.

19. The apparatus defined in claim 15 in which an annular reinforcement groove is formed in the punch core for forming an annular reinforcement rib in the end shell.

20. The apparatus defined in claim 15 including a pressurized air ejection device for ejecting the end shell from the press at the second level.

21. The apparatus defined in claim 15 in which a shoulder is formed on the punch shell engagable with an inner pressure sleeve for moving said inner pressure sleeve into clamping engagement with the elongated chuckwall when drawing the peripheral curl on the end shell.

22. The apparatus defined in claim 21 in which mutually engagable stops are formed on the punch core and inner pressure sleeve to limit reverse movement of the inner pressure sleeve and inner die core ring during drawing of the peripheral curl on the end shell.

23. A method of forming an end shell having a peripheral curl for use on a container at a single station in a press from sheet material including the step of:

cutting a blank from the sheet material at a first level;

forming a chuckwall against inner and outer die core rings by drawing an outer portion of the blank over a die core at a second level by advancing a punch shell;

applying a curl to a peripheral edge of the chuckwall prior to removal of the blank from the press by withdrawing the punch shell while simultaneously advancing the outer die core ring to move an outer peripheral portion of the chuckwall about a curl groove formed in an end of the outer die core ring; and discharging the end shell from the press at said second level.

24. The method defined in claim 23 including the step of forming a shallow cup by drawing the cut blank through a blank and draw die at the first level prior to forming the chuckwall.

25. The method defined in claim 24 including the steps of clamping the cup against the die core; and forming an end shell blank having the chuckwall upon advancing the punch shell toward the outer die core ring at the second level.

26. The method defined in claim 23 including the step of increasing an outer diameter of the peripheral edge of the chuckwall when applying the curl thereto.

27. The method defined in claim 23 including the step of maintaining a central portion of the end shell blank clamped between a punch core and a die core at the second level when applying the curl to the peripheral edge of the chuckwall.

28. The method defined in claim 27 including the step of forming an annular reinforcing rib in the end shell blank by advancing the inner die core ring toward the punch core while the punch core maintains the central portion of the blank clamped against the die core.

29. The method defined in claim 28 including the step of pushing metal from the chuckwall into a groove formed in the punch core free of any mating male die component during the stop of forming the annular reinforcing rib.

30. A method of forming an end shell having an annular reinforcing rib for use on a container from sheet material including the step of:

cutting a flat blank from the sheet material against a cut edge at a first level;

forming a cup-shaped blank having a bottom panel and a sidewall by drawing the flat blank through a blank and draw die;

clamping the bottom panel between a punch core and a die core at a second level;

providing the punch core with a female die component defining an annular reinforcement groove;

providing inner and outer concentric die core rings about the die core;

trapping an outer portion of the cup-shaped blank between the outer die core ring and a punch shell;

forming an end shell blank having an elongated chuckwall from the cup-shaped blank by advancing the punch shell and inner and outer die core rings below the second level; and reversing the direction of movement of the inner and outer die core rings and punch shell to push a portion of the end shell blank into the female die component free of any mating male die component to form the annular reinforcing rib on said end shell as the bottom panel remains clamped between the punch core and die core.

* * * * *